US010030473B2

(12) United States Patent
Tolman et al.

(10) Patent No.: US 10,030,473 B2
(45) **Date of Patent: *Jul. 24, 2018**

(54) METHOD FOR REMEDIATING A SCREEN-OUT DURING WELL COMPLETION

(71) Applicant: ExxonMobil Upstream Research Company, Spring, TX (US)

(72) Inventors: Randy C. Tolman, Spring, TX (US); Timothy I Morrow, Humble, TX (US); Timothy G Benish, Pearland, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 289 days.

This patent is subject to a terminal disclaimer.

(21) Appl. No.: 14/830,770

(22) Filed: Aug. 20, 2015

(65) Prior Publication Data

US 2016/0097259 A1 Apr. 7, 2016

Related U.S. Application Data

(60) Provisional application No. 62/059,517, filed on Oct. 3, 2014, provisional application No. 62/116,084, filed on Feb. 13, 2015.

(51) Int. Cl.

| | |
|---|---|
| ***E21B 34/06*** | (2006.01) |
| ***E21B 43/267*** | (2006.01) |
| ***E21B 34/10*** | (2006.01) |

(52) U.S. Cl.

CPC ..... *E21B 34/063* (2013.01); *E21B 34/103* (2013.01); *E21B 43/267* (2013.01)

(58) Field of Classification Search

CPC ..... E21B 34/14; E21B 34/063; E21B 34/103; E21B 43/11; E21B 43/116; E21B 43/11857; E21B 43/26; E21B 43/263; E21B 43/267; E21B 37/08; E21B 43/04; E21B 43/05

See application file for complete search history.

(56) References Cited

U.S. PATENT DOCUMENTS

| | | | | |
|---|---|---|---|---|
| 2,651,369 A * | 9/1953 | Abendroth | ..... | E21B 43/04 166/158 |
| 5,226,749 A | 7/1993 | Perkins | | |
| 5,234,055 A | 8/1993 | Cornett | | |

(Continued)

FOREIGN PATENT DOCUMENTS

| | | |
|---|---|---|
| RU | 2160360 C2 | 12/2000 |
| WO | WO 2015/080754 | 6/2015 |

*Primary Examiner* — David J Bagnell
*Assistant Examiner* — Jonathan Malikasim
(74) *Attorney, Agent, or Firm* — ExxonMobil Upstream Research Company—Law Department

(57) ABSTRACT

A method of completing a well involving remediating a condition of screen-out that has taken place along a zone of interest. The method includes forming a wellbore, and lining at least a lower portion of the wellbore with a string of production casing and placing a valve along the production casing, wherein the valve creates a removable barrier to fluid flow within the bore. The barrier is removed by moving the valve in the event of a screen-out. This overcomes the barrier to fluid flow, thereby exposing ports along the production casing to the subsurface formation at or below the valve. Additional pumping takes place to pump the slurry through the exposed ports, thereby remediating the condition of screen-out.

19 Claims, 17 Drawing Sheets

(56) References Cited

U.S. PATENT DOCUMENTS 5,396,954 A 3/1995 Brooks
5,536,115 A 7/1996 Keck
5,579,844 A 12/1996 Rebardi et al.
5,704,426 A 1/1998 Rytlewski et al.
5,829,520 A 11/1998 Johnson
5,909,774 A 6/1999 Griffith et al.
6,095,247 A 8/2000 Streich et al.
6,397,950 B1 6/2002 Streich et al.
6,513,599 B1 2/2003 Bixenman et al.
6,540,022 B2 * 4/2003 Dusterhoft ..... E21B 34/06 166/236
6,543,538 B2 4/2003 Tolman et al.
6,575,251 B2 6/2003 Watson et al.
6,581,689 B2 6/2003 Hailey, Jr.
6,601,646 B2 8/2003 Streich et al.
6,644,404 B2 11/2003 Schultz et al.
6,666,274 B2 12/2003 Hughes
6,695,067 B2 2/2004 Johnson et al.
6,732,800 B2 5/2004 Acock et al.
6,749,023 B2 6/2004 Nguyen et al.
6,752,206 B2 6/2004 Watson et al.
6,789,623 B2 9/2004 Hill, Jr. et al.
6,817,410 B2 11/2004 Wetzel et al.
6,830,104 B2 12/2004 Nguyen et al.
6,883,608 B2 4/2005 Parlar et al.
6,907,936 B2 6/2005 Fehr et al.
6,935,432 B2 8/2005 Nguyen
6,957,701 B2 10/2005 Tolman et al.
6,983,796 B2 1/2006 Bayne et al.
6,986,390 B2 1/2006 Doane et al.
6,997,263 B2 2/2006 Campbell et al.
7,044,231 B2 5/2006 Doane et al.
7,051,805 B2 5/2006 Doane et al.
7,055,598 B2 6/2006 Ross et al.
7,059,407 B2 6/2006 Tolman et al.
7,096,945 B2 8/2006 Richards et al.
7,100,691 B2 9/2006 Nguyen et al.
7,104,324 B2 9/2006 Wetzel et al.
7,168,494 B2 1/2007 Starr et al.
7,243,732 B2 7/2007 Richard
7,252,142 B2 8/2007 Brezinski et al.
7,264,061 B2 9/2007 Dybevik et al.
7,343,983 B2 3/2008 Livingstone
7,353,879 B2 4/2008 Todd et al.
7,367,395 B2 5/2008 Vidrine et al.
7,392,852 B2 7/2008 Richard
7,407,007 B2 8/2008 Tibbles
7,431,085 B2 10/2008 Coronado et al.
7,431,098 B2 10/2008 Ohmer et al.
7,441,605 B2 10/2008 Coronado et al.
7,477,160 B2 1/2009 Lemenager et al.
7,516,792 B2 4/2009 Lonnes et al.
7,562,709 B2 7/2009 Saebi et al.
7,575,062 B2 8/2009 East, Jr.
7,584,799 B2 9/2009 Coronado et al.
7,591,321 B2 9/2009 Whitsitt et al.
7,735,559 B2 6/2010 Malone
7,798,236 B2 9/2010 McKeachnie et al.
8,167,047 B2 5/2012 Themig et al.
8,215,411 B2 7/2012 Flores et al.
8,220,542 B2 7/2012 Whitsitt et al.
8,237,585 B2 8/2012 Zimmerman
8,267,177 B1 9/2012 Vogel et al.
8,276,670 B2 10/2012 Patel
8,330,617 B2 12/2012 Chen et al.
8,347,982 B2 1/2013 Hannegan et al.
8,496,055 B2 7/2013 Mootoo et al.
8,607,864 B2 * 12/2013 Mcleod ..... E21B 43/26 166/250.1
2002/0007949 A1 1/2002 Tolman et al.
2003/0188871 A1 10/2003 Dusterhoft et al.
2004/0007829 A1 1/2004 Ross
2004/0016549 A1 * 1/2004 Selinger ..... E21B 34/085 166/369
2004/0084190 A1 5/2004 Hill et al.
2005/0034859 A1 * 2/2005 Caillier ..... E21B 43/04 166/278
2005/0039917 A1 2/2005 Hailey, Jr.
2005/0103495 A1 * 5/2005 Corbett ..... E21B 34/14 166/278
2005/0263287 A1 12/2005 Achee, Jr. et al.
2006/0118301 A1 6/2006 East, Jr. et al.
2007/0056750 A1 3/2007 John et al.
2007/0227727 A1 * 10/2007 Patel ..... E21B 17/028 166/250.01
2008/0093073 A1 4/2008 Bustos et al.
2008/0125335 A1 5/2008 Bhavsar
2008/0142222 A1 6/2008 Howard et al.
2008/0314589 A1 12/2008 Guignard et al.
2009/0084556 A1 4/2009 Richards et al.
2009/0101334 A1 4/2009 Baser et al.
2009/0159279 A1 6/2009 Assal
2009/0159298 A1 6/2009 Assal
2009/0283279 A1 11/2009 Patel et al.
2010/0084134 A1 4/2010 Tulissi et al.
2010/0155064 A1 6/2010 Nutley et al.
2010/0212906 A1 8/2010 Fulton et al.
2011/0048743 A1 3/2011 Stafford et al.
2011/0168403 A1 7/2011 Patel
2012/0043079 A1 2/2012 Wassouf et al.
2012/0085548 A1 4/2012 Fleckenstein et al.
2012/0090687 A1 4/2012 Grigsby et al.
2012/0111566 A1 5/2012 Sherman et al.
2012/0199349 A1 8/2012 Themig et al.
2012/0205120 A1 8/2012 Howell
2012/0292053 A1 11/2012 Xu et al.
2013/0008648 A1 1/2013 Lovorn et al.
2013/0062055 A1 * 3/2013 Tolman ..... E21B 23/00 166/250.01
2013/0105159 A1 5/2013 Alvarez et al.
2013/0199790 A1 8/2013 Themig et al.
2013/0206425 A1 8/2013 Mazyar et al.
2013/0248174 A1 9/2013 Dale et al.
2015/0068762 A1 * 3/2015 Naedler ..... E21B 34/14 166/373
2015/0075785 A1 * 3/2015 Brekke ..... E21B 34/10 166/250.01
2016/0108711 A1 * 4/2016 Lynk ..... E21B 43/26 166/297

* cited by examiner

METHOD FOR REMEDIATING A SCREEN-OUT DURING WELL COMPLETION

CROSS-REFERENCE TO RELATED APPLICATIONS

This application claims the priority benefit of U.S. Provisional Patent Application No. 62/059,517, filed 3 Oct. 2014, titled "Method For Remediating A Screen-Out During Well Completion," and U.S. Provisional Patent Application No. 62/116,084, filed 13 Feb. 2015, titled "Method For Remediating A Screen-Out During Well Completion," the entireties of which are incorporated by reference herein. This application is related to co-pending U.S. patent application Ser. No. 13/989,728, filed 24 May 2013, titled "Autonomous Downhole Conveyance System," which published as U.S. Patent Publ. No. 2013/0248174. This application is also related to co-pending U.S. patent application Ser. No. 13/697,769, filed 13 Nov. 2012, titled "Assembly and Method for Multi-Zone Fracture Stimulation of a Reservoir Using Autonomous Tubular Units," which published as U.S. Patent Publ. No. 2013/0062055. Both applications are incorporated herein in their entireties by reference.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

This invention relates generally to the field of wellbore operations. More specifically, the invention relates to completion processes wherein multiple zones of a subsurface formation are fractured in stages.

GENERAL DISCUSSION OF TECHNOLOGY

In the drilling of oil and gas wells, a wellbore is formed using a drill bit that is urged downwardly at a lower end of a drill string. After drilling to a predetermined bottomhole location, the drill string and bit are removed and the wellbore is lined with a string of casing. An annular area is thus formed between the string of casing and the surrounding formations.

A cementing operation is typically conducted in order to fill or "squeeze" the annular area with columns of cement. The combination of cement and casing strengthens the wellbore and facilitates the zonal isolation of the formations behind the casing.

It is common to place several strings of casing having progressively smaller outer diameters into the wellbore. A first string may be referred to as surface casing. The surface casing serves to isolate and protect the shallower, freshwater-bearing aquifers from contamination by any other wellbore fluids. Accordingly, this casing string is almost always cemented entirely back to the surface.

A process of drilling and then cementing progressively smaller strings of casing is repeated several times below the surface casing until the well has reached total depth. In some instances, the final string of casing is a liner, that is, a string of casing that is not tied back to the surface. The final string of casing, referred to as a production casing, is also typically cemented into place. In some completions, the production casing (or liner) has swell packers or external casing packers spaced across selected productive intervals. This creates compartments between the packers for isolation of zones and specific stimulation treatments. In this instance, the annulus may simply be packed with sand.

As part of the completion process, the production casing is perforated at a desired level. This means that lateral holes are shot through the casing and the cement column surrounding the casing. The perforations allow reservoir fluids to flow into the wellbore. In the case of swell packers or individual compartments, the perforating gun penetrates the casing, allowing reservoir fluids to flow from the rock formation into the wellbore along a corresponding zone.

After perforating, the formation is typically fractured at the corresponding zone. Hydraulic fracturing consists of injecting water with friction reducers or viscous fluids (usually shear thinning, non-Newtonian gels or emulsions) into a formation at such high pressures and rates that the reservoir rock parts and forms a network of fractures. The fracturing fluid is typically mixed with a proppant material such as sand, crushed granite, ceramic beads, or other granular materials. The proppant serves to hold the fracture(s) open after the hydraulic pressures are released. In the case of so-called "tight" or unconventional formations, the combination of fractures and injected proppant substantially increases the flow capacity of the treated reservoir.

In order to further stimulate the formation and to clean the near-wellbore regions downhole, an operator may choose to "acidize" the formations. This is done by injecting an acid solution down the wellbore and through the perforations. The use of an acidizing solution is particularly beneficial when the formation comprises carbonate rock. In operation, the completion company injects a concentrated formic acid or other acidic composition into the wellbore and directs the fluid into selected zones of interest. The acid helps to dissolve carbonate material, thereby opening up porous channels through which hydrocarbon fluids may flow into the wellbore. In addition, the acid helps to dissolve drilling mud that may have invaded the formation.

Application of hydraulic fracturing and acid stimulation as described above is a routine part of petroleum industry operations as applied to individual hydrocarbon-producing formations (or "pay zones"). Such pay zones may represent up to about 60 meters (100 feet) of gross, vertical thickness of subterranean formation. More recently, wells are being completed through a hydrocarbon-producing formation horizontally, with the horizontal portion extending possibly 5,000, 10,000 or even 15,000 feet.

When there are multiple or layered formations to be hydraulically fractured, or a very thick hydrocarbon-bearing formation (over about 40 meters, or 131 feet), or where an extended-reach horizontal well is being completed, then more complex treatment techniques are required to obtain treatment of the entire target formation. In this respect, the operating company must isolate various zones or sections to ensure that each separate zone is not only perforated, but adequately fractured and treated. In this way, the operator is sure that fracturing fluid and stimulant are being injected through each set of perforations and into each zone of interest to effectively increase the flow capacity at each desired depth.

The isolation of various zones for pre-production treatment requires that the intervals be treated in stages. This, in turn, involves the use of so-called diversion methods. In petroleum industry terminology, "diversion" means that injected fluid is diverted from entering one set of perforations so that the fluid primarily enters only one selected zone of interest. Where multiple zones of interest are to be perforated, this requires that multiple stages of diversion be carried out.

In order to isolate selected zones of interest, various diversion techniques may be employed within the wellbore. In many cases, mechanical devices such as fracturing bridge plugs, down-hole valves, sliding sleeves (known as "frac sleeves"), and baffle/plug combinations are used.

A problem sometimes encountered during a "perf-and-frac" process is the so-called screen-out. Screen-out occurs when the proppant being injected as part of the fracturing fluid slurry tightly packs the fractures and perforation tunnels near the wellbore. This creates a blockage such that continued injection of the slurry inside the fractures requires pumping pressures in excess of the safe limitations of the wellbore or wellhead equipment. Operationally, this causes a disruption in fracturing operations and requires cessation of pumping and cleaning of the wellbore before resumption of operations. In horizontal well fracturing, screen-outs disrupt well operations and cause cost overruns.

Where the operator is pumping slurry while a live perforating gun is in the hole, the operator may be able to remedy a screen-out by shooting a new set of perforations during pumping. This may be done where a multi-zone stimulation technique is being employed. In this instance, the operator sends a signal to a bottom hole assembly that includes various perforating guns having associated charges. Examples of multi-zone stimulation techniques using such a bottom hole assembly include the "Just-In-Time Perforating" (JITP) technique and the "ACT Frac" technique. In these processes, a substantially continuous treatment of zones takes place.

The benefit of the bottom hole assemblies used for JITP and ACT Frac processes is that they allow the operator to perforate the casing along various zones of interest and then sequentially isolate the respective zones of interest so that fracturing fluid may be injected into several zones of interest in the same trip. Fortuitously, each of these multi-zone stimulation techniques also offers the ability to create, as needed, proppant disposal zones to clean up the wellbore by perforating a new section of rock (JITP) or to simply circulate proppant out of the well using the coil tubing in the wellbore (ACT Frac) in the event of a screen-out. However, in more traditional completions where a single zone stimulation is being conducted or where multiple perforation clusters are being treated at one time, screen-outs can require a change-out of completion equipment at the surface and a considerable delay in operations.

Recently, a new type of completion procedure has been developed that employs so-called autonomous tools. These are tools that are dropped into the wellbore and which are not controlled from the surface; instead, these tools include one or more sensors (such as a casing collar locator) that interact with a controller on the tool to self-determine location within a wellbore. As the autonomous tool is pumped downhole, the controller ultimately identifies a target depth and sends an actuation signal, causing an action to take place. Where the tool is a bridge plug, the plug is set in the wellbore at a desired depth. Similarly, where the tool is a perforating gun, one or more detonators is fired to send "shots" into the casing and the surrounding subsurface formation. Unfortunately, autonomous perforating guns cannot be pumped into a wellbore when a screen-out occurs; thus, they fall into the class of completions that requires a change-out of completion equipment at the surface during screen-out.

Additionally, it is observed that even the JITP and ACT-Frac procedures are vulnerable to screen-out complications at the highest zone of a perf-and-frac stage. (This is demonstrated in connection with FIG. 1F, below.)

Accordingly, a need exists for a process of remediating a wellbore during a condition of screen-out without interrupting the pumping process. Further, a need exists for a completion technique that enables an autonomous perforating tool to be deployed in a wellbore even during a condition of screen-out.

SUMMARY OF THE INVENTION

The methods described herein have various benefits in the conducting of oil and gas drilling and completion activities. Specifically, methods for completing a well are provided.

In one aspect, a method of completing a well first includes forming a wellbore. The wellbore defines a bore that extends into a subsurface formation. The wellbore may be formed as a substantially vertical well; more preferably, the well is formed by drilling a deviated or even a horizontal well.

The method also includes lining the wellbore with a string of production casing. The production casing is made up of a series of steel pipe joints that are threadedly connected, end-to-end.

The method further includes placing a valve along the production casing. The valve may be inserted into a casing string or made up integrally with the casing string. The valve creates a removable barrier to fluid flow within the bore. Preferably, the valve is a sliding sleeve having a seat that receives a ball, wherein the ball is dropped from the surface to create a pressure seal on the seat. The sleeve is held in place by shear pins, which are engineered to shear when the pressure above the sleeve exceeds a predetermined set point. This opens the ports for treatment of the zone or stage. If an estimated screen-out pressure is exceeded during treatment, additional shear pins holding the seat will shear, releasing the valve downhole. Other types of valves may also be used as described below.

The method also comprises perforating the production casing. The casing is perforated along a first zone of interest within the subsurface formation. The first zone of interest resides at or above the valve. The process of perforating involves firing shots into the casing, through a surrounding cement sheath, and into the surrounding rock matrix making up a subsurface formation. This is done by using a perforating gun in the wellbore.

The method next includes injecting a slurry into the wellbore. The slurry comprises a fracturing proppant, preferably carried in an aqueous medium.

The method further includes pumping the slurry at a pressure sufficient to move the valve and to overcome the barrier to fluid flow. This is done in response to a condition of screen-out along the first zone of interest created during the slurry injection. Moving the valve exposes ports along the production casing to the subsurface formation at or below the valve.

The method additionally includes further pumping the slurry through the exposed ports, thereby remediating the condition of screen-out above the valve.

In one aspect of the method, the valve is a sliding sleeve. In this instance, moving the valve to expose ports along the production casing comprises moving or "sliding" the sleeve to expose one or more ports fabricated in the sliding sleeve.

This may include the shearing of set pins.

In another embodiment, the method further includes placing a fracturing baffle along the production casing. The fracturing baffle resides above the sliding sleeve but at or below the first zone of interest. The fracturing baffle may be part of a sub that is threadedly connected to the production casing proximate the sliding sleeve during initial run-in. A rupture disc is then pumped down the wellbore ahead of the slurry. The disc is pumped to a depth just above the valve until the disc lands on the fracturing baffle. In this embodiment, the rupture disc is designed to rupture at a pressure that is greater than a screen-out pressure, but preferably lower than the pressure required to move the valve.

Optionally, the operator may inject a fluid (such as an aqueous fluid) under pressure through the exposed port of the sliding sleeve, thereby creating mini-fractures in the subsurface formation below the first zone of interest. This step is done by the operator before pumping the rupture disc into the wellbore.

In another embodiment, the valve is a first burst plug. The first burst plug will have a first burst rating. The ports represent perforations that are placed in the production casing in a second zone of interest below the first zone of interest. In this embodiment, moving the valve to expose ports comprises injecting the slurry at a pressure that exceeds the burst rating of the first burst plug. Optionally, in this embodiment, the method further includes placing a second and a third burst plug along the production casing at or below the second zone of interest, creating a domino-effect in the event of multiple screen-outs. The second and third burst plugs will have a burst rating that is equal to or greater than the first burst rating.

In still another aspect, the valve that is moved is a ball-and-seat valve, while the ports are perforations earlier placed in the production casing in a second zone of interest below the first zone of interest. In this instance, moving the valve to expose ports comprises injecting the slurry at a pressure that causes the ball to lose its pressure seal on the seat. Causing the ball to lose its pressure seal may define causing the ball to shatter, causing the ball to dissolve, or causing the ball to collapse.

In a preferred embodiment, perforating the production casing comprises pumping an autonomous perforating gun assembly into the wellbore, and autonomously firing the perforating gun along the first zone of interest. The autonomous perforating gun assembly comprises a perforating gun, a depth locator for sensing the location of the assembly within the wellbore, and an on-board controller. "Autonomously firing" means pre-programming the controller to send an actuation signal to the perforating gun to cause one or more detonators to fire when the locator has recognized a selected location of the perforating gun along the wellbore. In one aspect, the depth locator is a casing collar locator and the on-board controller interacts with the casing collar locator to correlate the spacing of casing collars along the wellbore with depth according to an algorithm. The casing collar locator identifies collars by detecting magnetic anomalies along a casing wall.

It is observed that the perforating gun, the locator, and the on-board controller are together dimensioned and arranged to be deployed in the wellbore as an autonomous unit. In this application, "autonomous unit" means that the assembly is not immediately controlled from the surface. Stated another way, the tool assembly does not rely upon a signal from the surface to know when to activate the tool. Preferably, the tool assembly is released into the wellbore without a working line. The tool assembly either falls gravitationally into the wellbore, or is pumped downhole. However, a non-electric working line such as slickline may optionally be employed.

In another aspect, an autonomous perforating gun assembly is deployed in the wellbore after a condition of screen-out has been remediated. The perforating gun assembly is used to fire a new set of perforations along the first zone of interest. In this way, a new fracturing process may be initiated in that zone of interest.

BRIEF DESCRIPTION OF THE DRAWINGS

So that the present inventions can be better understood, certain drawings, charts, graphs, and/or flow charts are appended hereto. It is to be noted, however, that the drawings illustrate only selected embodiments of the inventions and are therefore not to be considered limiting of scope, for the inventions may admit to other equally effective embodiments and applications.

FIG. 1A presents a wellbore having been lined with a string of production casing. Annular packers are placed along the wellbore to isolate selected subsurface zones. The zones are identified as "A," "B" and "C."

FIG. 1B illustrates Zone A of the wellbore having been perforated. Further, fractures have been formed in the subsurface formation along Zone A using any known hydraulic fracturing technique.

FIG. 1C illustrates that a plug has been set adjacent a packer intermediate Zones A and B. Further, a perforating gun is shown forming new perforations along Zone B.

FIG. 1D illustrates a fracturing fluid, or slurry, being pumped into the wellbore, with artificial fractures being induced in the subsurface formation along Zone B.

FIG. 1E illustrates that ball sealers have been dropped into the wellbore, thereby sealing perforations along Zone B. Further, a perforating gun is now indicated along Zone C. The casing along Zone C is being perforated.

FIG. 1F illustrates fracturing fluid, or slurry, being pumped into the wellbore. Artificial fractures are being induced in the subsurface formation along Zone C.

FIG. 2A presents a wellbore having been lined with a string of production casing. Annular packers are placed along the wellbore to isolate selected subsurface zones. The zones are identified as "A," "B" and "C."

FIG. 2B illustrates Zone A of the wellbore having been perforated using a perforating gun. A plug has been run into the wellbore with the perforating gun.

FIG. 2C illustrates that fractures have been formed in the subsurface formation along Zone A using a fracturing fluid. Proppant is seen residing now in an annular region along Zone A.

FIG. 2D illustrates that a second plug has been set adjacent a packer intermediate Zones B and C. Further, a perforating gun is shown forming perforations along Zone B.

FIG. 2E illustrates that fracturing fluid is being pumped into the wellbore, with artificial fractures being induced in the subsurface formation along Zone B.

FIG. 2F illustrates that a third plug has been set adjacent a packer intermediate Zones B and C. Further, a perforating gun is shown forming perforations along Zone C.

FIG. 3A presents a wellbore having been lined with a string of production casing. Annular packers are placed along the wellbore to isolate selected subsurface zones. The zones are identified as "A," "B" and "C."

FIG. 3B illustrates that a ball has been dropped onto a fracturing sleeve in Zone A.

FIG. 3C illustrates that hydraulic pressure has been applied to open the fracturing sleeve in Zone A by pumping a fracturing fluid into the wellbore. Further, fractures are being induced in the subsurface formation along Zone A. Proppant is seen residing now in an annular region along Zone A.

FIG. 3D illustrates that a second ball has been dropped. The ball has landed on a fracturing sleeve in Zone B.

FIG. 3E illustrates that hydraulic pressure has been applied to open the fracturing sleeve in Zone B by pumping a fracturing fluid into the wellbore. Further, fractures are being induced in the subsurface formation along Zone B. Proppant is seen residing now in an annular region along Zone B.

FIG. 3F illustrates that a third ball has been dropped. The ball has landed on a fracturing sleeve in Zone C. Zone C is ready for treatment.

FIG. 4A presents the wellbore with a sliding sleeve threadedly connected in line with a string of production casing. A ball is being pumped into the wellbore to actuate the sliding sleeve.

FIG. 4B illustrates that the ball has landed onto a seat of the sliding sleeve. The sleeve has been actuated, exposing a port. In addition, a hydraulic fluid has been pumped into the wellbore to open small fractures.

FIG. 4C is another view of the wellbore of FIG. 4A. Here, a rupture disc is being pumped down the wellbore.

FIG. 4D illustrates that the rupture disc has landed on a baffle seat. The seat is upstream from the sliding sleeve. In addition, the production casing has been perforated above the baffle seat.

FIG. 4E is another view of the wellbore of FIG. 4A. Here, a fracturing fluid is being pumped down the wellbore and through the perforations. Fractures are being formed in the subsurface formation.

FIG. 4F illustrates that the fracturing fluid continues to be pumped down the wellbore in response to a condition of screen-out at the perforations. Pumping pressure has caused the rupture disc to be breached, allowing slurry to move down the wellbore and towards the exposed ports.

FIG. 5A presents the wellbore with a rupture disc landed on a baffle seat. The wellbore has received perforations both above and below the baffle seat. The subsurface formation is being fractured through the upper perforations.

FIG. 5B is another view of the wellbore of FIG. 5A. Fracturing fluid continues to be pumped down the wellbore in response to a condition of screen-out at the upper perforations. Pumping pressure has caused the rupture disc to be breached, allowing slurry to move down the wellbore and towards the lower perforations.

FIG. 6A presents the wellbore with an upper rupture disc landed on an upper baffle seat. The wellbore has received perforations both above and below the upper baffle seat. The subsurface formation is being fractured through the upper perforations.

FIG. 6B is another view of the wellbore of FIG. 6A. Fracturing fluid continues to be pumped down the wellbore in response to a condition of screen-out at the upper perforations. Pumping pressure has caused the upper rupture disc to be breached, allowing slurry to move down the wellbore and towards the lower perforations.

FIG. 7A presents the wellbore with a collapsible ball landed on the seat. The wellbore has received perforations both above and below the seat. The subsurface formation is being fractured through the upper perforations.

FIG. 7B is another view of the wellbore of FIG. 7A. Fracturing fluid continues to be pumped down the wellbore in response to a condition of screen-out at the upper perforations. Pumping pressure has caused the ball to collapse, allowing slurry to move down the wellbore and towards the lower perforations.

DETAILED DESCRIPTION OF CERTAIN EMBODIMENTS

Definitions

Figure 1A:
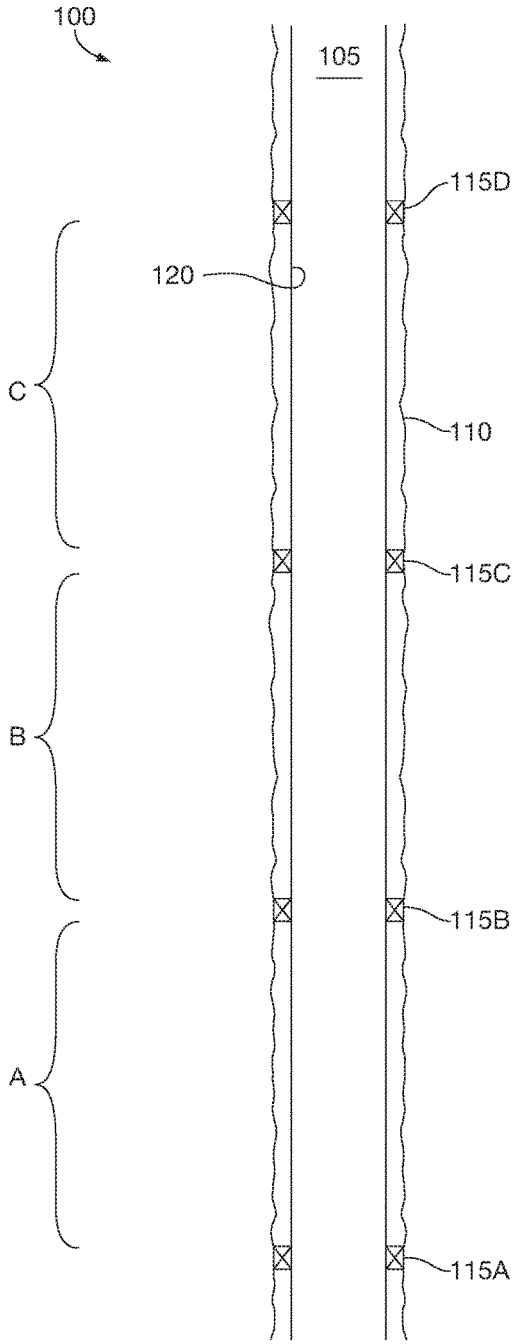
FIG. 1A Prior Art
FIGS. 1A through 1F present a series of side views of a lower portion of a wellbore. The wellbore is undergoing a completion procedure that uses perforating guns and ball sealers in stages. This is a known procedure.

As used herein, the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur. Hydrocarbons generally fall into two classes: aliphatic, or straight chain, hydrocarbons; and cyclic, or closed ring, hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient conditions (15° C. to 20° C. and 1 atm pressure). Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, carbon dioxide, hydrogen sulfide, and water (including steam).

As used herein, the term "fluid" refers to gases, liquids, and combinations of gases and liquids, as well as to combinations of gases and solids, combinations of liquids and solids, and combinations of gases, liquids, and solids.

As used herein, the term "gas" refers to a fluid that is in its vapor phase at 1 atm and 15° C.

As used herein, the term "oil" refers to a hydrocarbon fluid containing primarily a mixture of condensable hydrocarbons.

As used herein, the term "subsurface" refers to geologic strata occurring below the earth's surface.

As used herein, the term "formation" refers to any definable subsurface region. The formation may contain one or more hydrocarbon-containing layers, one or more non-hydrocarbon containing layers, an overburden, and/or an underburden of any geologic formation.

The terms "zone" or "zone of interest" refer to a portion of a formation containing hydrocarbons. Alternatively, the formation may be a water-bearing interval.

For purposes of the present application, the term "production casing" includes a liner string or any other tubular body fixed in a wellbore along a zone of interest, which may or may not extend to the surface.

As used herein, the term "wellbore" refers to a hole in the subsurface made by drilling or insertion of a conduit into the subsurface. A wellbore may have a substantially circular cross section, or other cross-sectional shapes. As used herein, the term "well," when referring to an opening in the formation, may be used interchangeably with the term "wellbore."

DESCRIPTION OF SELECTED SPECIFIC EMBODIMENTS

The inventions are described herein in connection with certain specific embodiments. However, to the extent that the following detailed description is specific to a particular embodiment or a particular use, such is intended to be illustrative only and is not to be construed as limiting the scope of the inventions.

Certain aspects of the inventions are also described in connection with various figures. In certain of the figures, the top of the drawing page is intended to be toward the surface, and the bottom of the drawing page toward the well bottom. While wells historically have been completed in substantially vertical orientation, it is understood that wells now are frequently inclined and/or even horizontally completed. When the descriptive terms "up" and "down" or "upper" and "lower" or similar terms are used in reference to a drawing or in the claims, they are intended to indicate relative location on the drawing page or with respect to claim terms, and not necessarily orientation in the ground, as the present inventions have utility no matter how the wellbore is orientated.

Wellbore completions in unconventional reservoirs are increasing in length. Whether such wellbores are vertical or horizontal, such wells require the placement of multiple perforation sets and multiple fractures. Known completions, in turn, require the addition of downhole hardware which increases the expense, complexity, and risk of such completions.

Several techniques are known for fracturing multiple zones along an extended wellbore incident to hydrocarbon production operations. One such technique involves the use of perforating guns and ball sealers run in stages.

FIGS. 1A through 1F present a series of side views of a lower portion of an extended wellbore 100. The wellbore 100 is undergoing a completion procedure that uses perforating guns 150 and ball sealers 160 in stages.

First, FIG. 1A introduces the wellbore 100. The wellbore 100 is lined with a string of production casing 120. The production casing 120 defines a long series of pipe joints that are threadedly coupled, end-to-end. The production casing 120 provides a bore 105 for the transport of fluids into the wellbore 100 and out of the wellbore 100.

The production casing 120 resides within a surrounding subsurface formation 110. Annular packers are placed along the casing 120 to isolate selected subsurface zones. Three illustrative zones are shown in the FIG. 1 series, identified as "A," "B" and "C." The packers, in turn, are designated as 115A, 115B, 115C, and 115D, and are generally placed intermediate the zones.

Figure 1B:
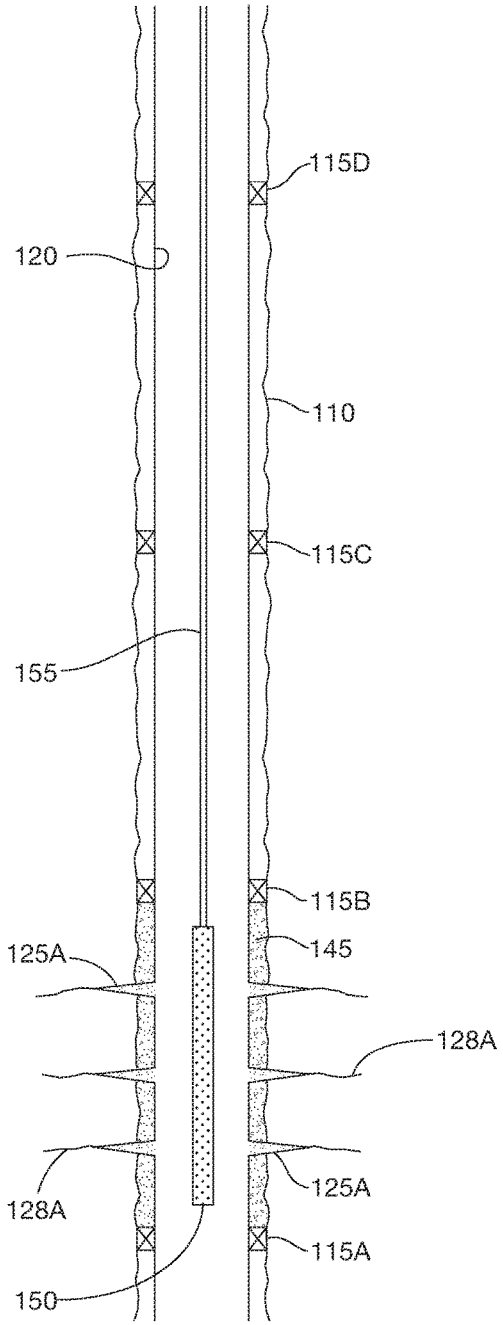
FIG. 1B Prior Art

It is desirable to perforate and fracture the formation along each of Zones A, B and C. FIG. 1B illustrates Zone A having been perforated. Perforations 125A are placed by detonating charges associated with a perforating gun 150. Further, fractures 128A have been formed in the subsurface formation 110 along Zone A. The fractures 128A are formed using any known hydraulic fracturing technique.

It is observed that in connection with the formation of the fractures 128A, a hydraulic fluid 145 having a proppant is used. The proppant is typically sand and is used to keep the fractures 128A open after hydraulic pressure is released from the formation 110. It is also observed that after the injection of the hydraulic fluid 145, a thin annular gravel pack is left in the region formed between the casing 120 and the surrounding formation 110. This is seen between packers 115A and 115B. The gravel pack beneficially supports the surrounding formation 110 and helps keeps fines from invading the bore 105.

Figure 1C:
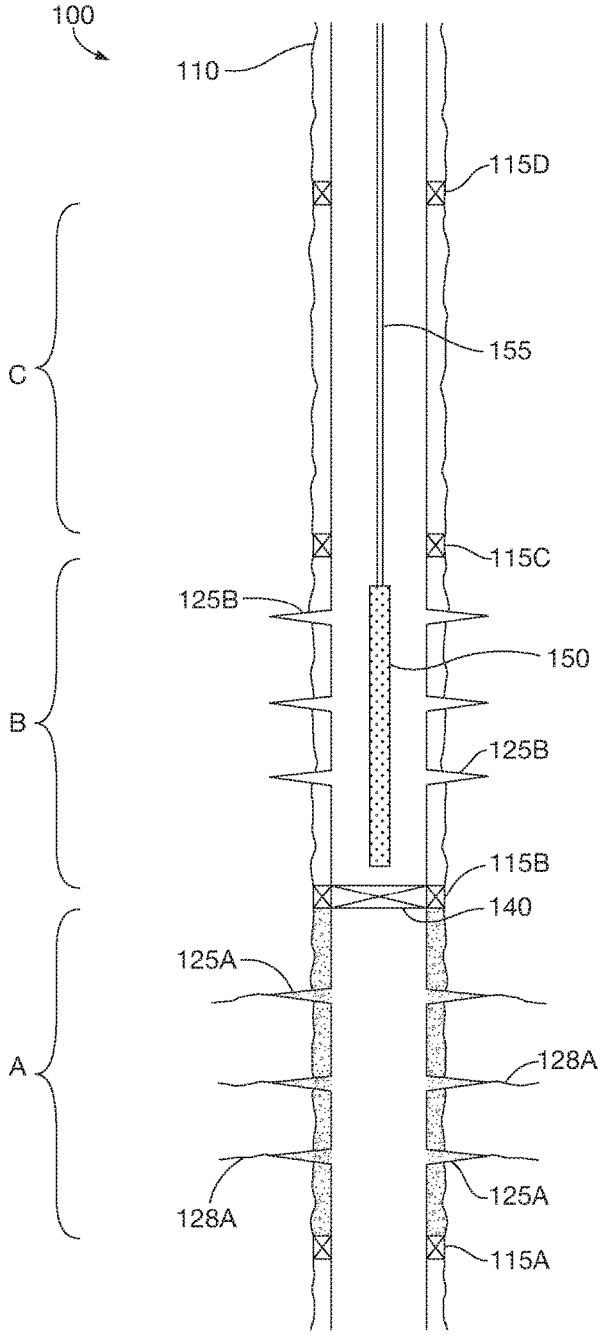
FIG. 1C Prior Art

As a next step, Zone B is fractured. This is shown in FIG. 1C. FIG. 1C illustrates that a plug 140 has been set adjacent the packer 115B intermediate Zones A and B. Further, the perforating gun 150 has been placed along Zone B. Additional charges associated with the perforating gun 150 are detonated, producing perforations 125B.

Figure 1D:
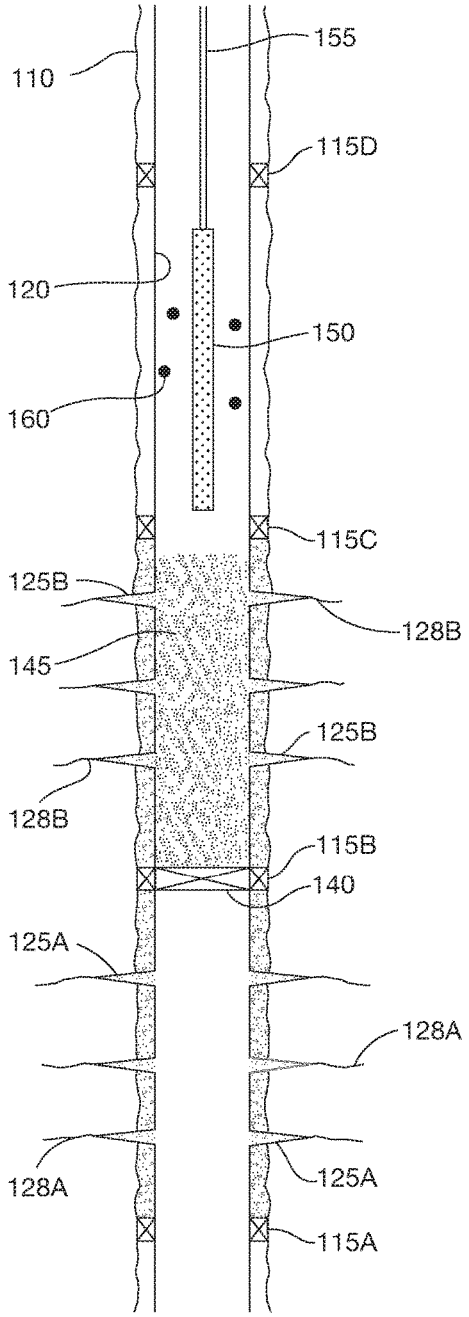
FIG. 1D Prior Art

Next, FIG. 1D illustrates that a fracturing fluid 145 is being pumped into the bore 105. Artificial fractures 128B are being formed in the subsurface formation 110 along Zone B.

In addition, a new perforating gun 150 has been lowered into the wellbore 100 and placed along Zone C. Ball sealers 160 have been dropped into the wellbore.

Figure 1E:
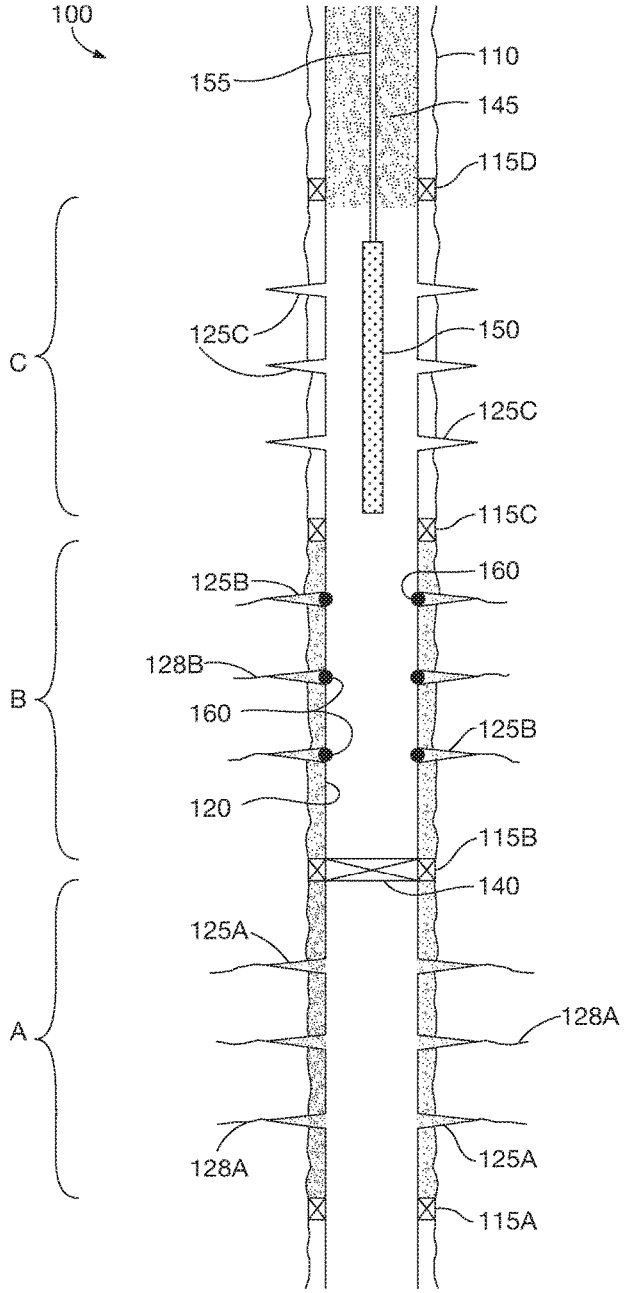
FIG. 1E Prior Art

FIG. 1E illustrates a next step in the completion of the multi-zone wellbore 100. In FIG. 1E, the ball sealers 160 have fallen in the bore 105 and have landed along Zone B. The ball sealers 160 seal the perforations 125B.

It is also observed in FIG. 1E that the perforating gun 150 has been raised in the wellbore 100 up to Zone C. Remaining charges associated with the perforating gun 150 are detonated, producing new perforations 125C. After perforating, a fracturing fluid 145 is pumped into the bore 105 behind the perforating gun 150.

Figure 1F:
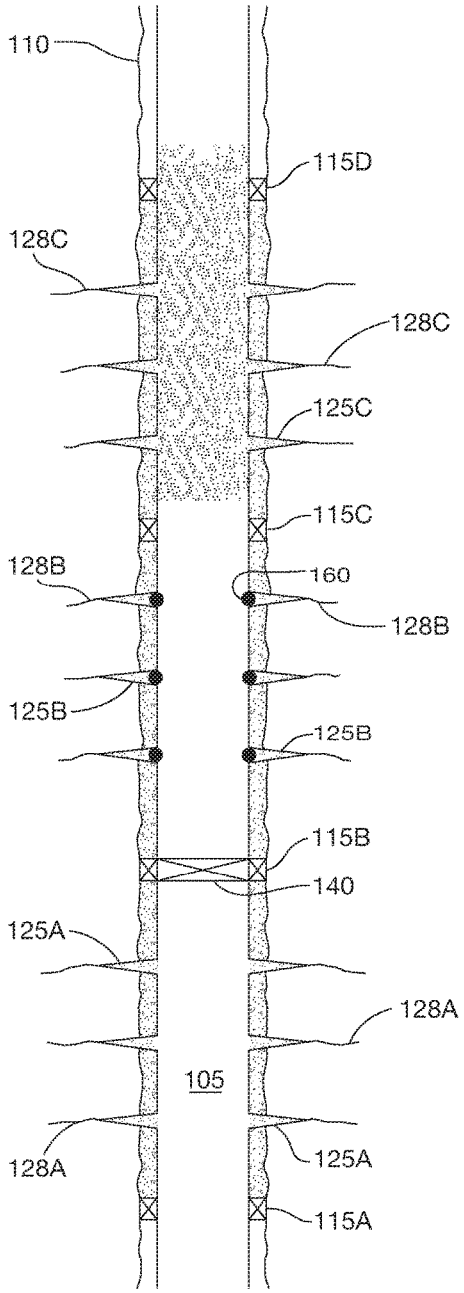
FIG. 1F Prior Art

Finally, FIG. 1F illustrates the fracturing fluid 145 being pumped further into the wellbore 100. Specifically, the fracturing fluid 145 is pumped through the new perforations 125C along Zone C. Artificial fractures 128C have been induced in the subsurface formation 120 along Zone C. The firing charges in the perforating gun 150 are now spent and the gun is pulled out of the wellbore 100.

The multi-zone completion procedure of FIGS. 1A through 1F is known as the "Just-In-Time Perforating" (JITP) process. The JITP process represents a highly efficient method in that a fracturing fluid may be run into the wellbore with a perforating gun in the hole. As soon as the perfs are shot and fractures are formed, ball sealers are dropped. When the ball sealers seat on the perforations, a gun is shot at the next zone. These steps are repeated for multiple zones until all guns are spent. A new plug 140 is then set and the process begins again.

The JITP process requires low flush volumes and offers the ability to manage screen-outs along the zones. However, it does require that multiple plugs be drilled out in an extended well. In addition, even this procedure is vulnerable to screen-out at the highest zone of a multi-zone stage. In this respect, if a screen-out occurs along illustrative Zone C during pumping, clean-out operations will need to be conducted. This is because the slurry 145 cannot be completely pumped through the perforations 125C and into the formation, due to the presence of the ball sealers 160 along Zone B and the bridge plug 140 above Zone A.

An alternate completion procedure that has been used is the traditional "Plug and Perf" technique. This is illustrated in FIGS. 2A through 2F. The FIG. 2 drawings present a series of side views of a lower portion of a wellbore 200. The wellbore 200 is undergoing a completion procedure that uses perforating plugs 240 and guns 250 in stages.

Figure 2A:
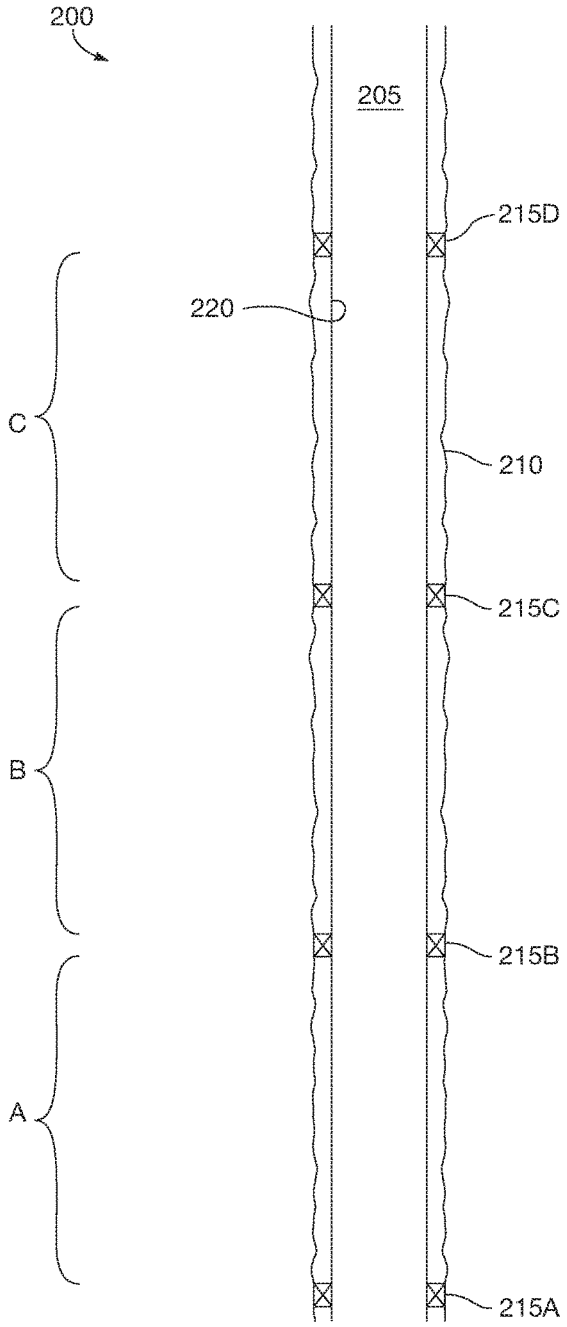
FIG. 2A Prior Art
FIGS. 2A through 2F present a series of side views of a lower portion of a wellbore. The wellbore is undergoing a completion procedure that uses perforating guns and plugs in stages. This is a known procedure.

FIG. 2A presents a wellbore 200 that has been lined with a string of production casing 220. The wellbore 200 is identical to the wellbore 100 of FIG. 1A. The wellbore 200 is lined with a string of production casing 220. The production casing 220 provides a bore 205 for the transport of fluids into the wellbore 200 and out of the wellbore 200. The production casing 220 resides within a surrounding subsurface formation 210.

Annular packers are again placed along the casing 220 to isolate selected subsurface zones, identified as "A," "B" and "C." The packers, in turn, are designated as 215A, 215B, 215C, and 215D.

Figure 2B:
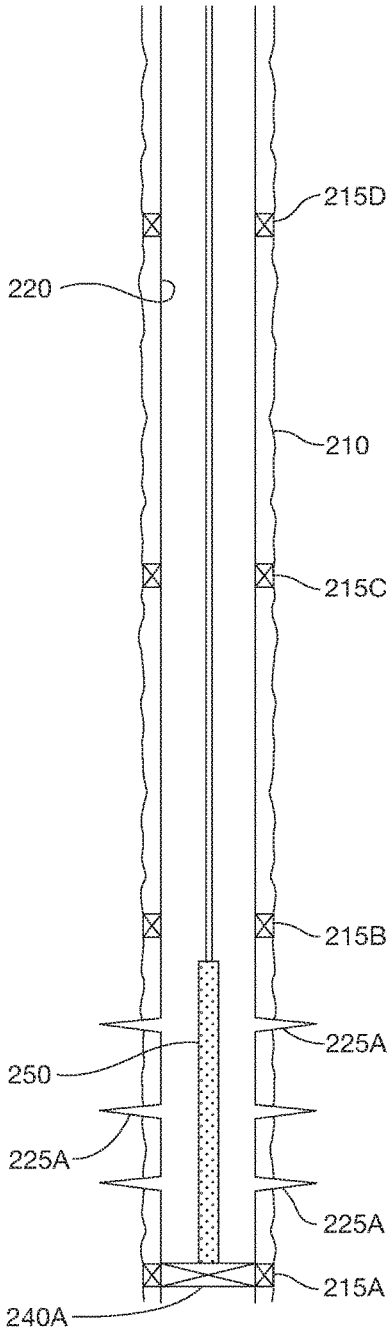
FIG. 2B Prior Art

In order to complete the wellbore 200, Zones A, B, and C are each perforated. In FIG. 2B, a perforating gun 250 has been run into the bore 205. The gun 250 has been placed along Zone A. Perforations 225A have been formed in the production casing 120 by detonating charges associated with the perforating gun 250.

Along with the perforating gun 250, a plug 240A has been set. In practice, the plug 240A is typically run into the bore 205 at the lower end of the perforating gun on the wireline 255. In other words, the plug 240A and the gun 250 are run into the wellbore 200 together before the charges are detonated.

Next, a fracturing fluid 245 is injected into the newly-formed perforations 225A. The fracturing fluid 245, with proppant, is injected under pressure in order to flow through the perforations 225A and into the formation 210. In this way, artificial fractures 228A are formed.

Figure 2C:
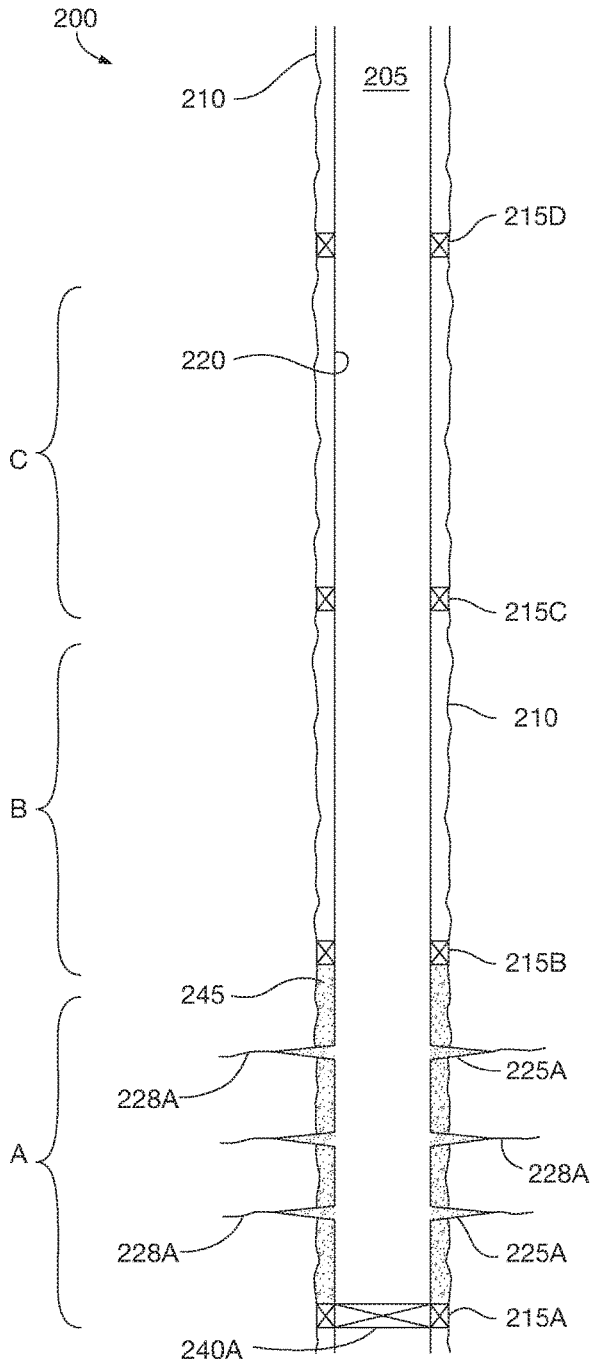
FIG. 2C Prior Art
Figure 2D:
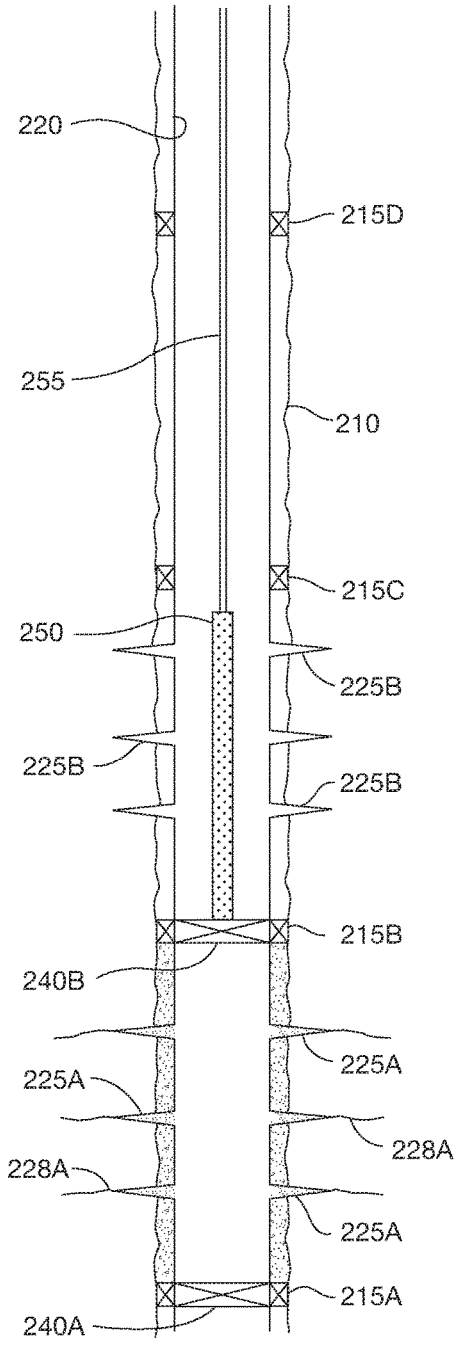
FIG. 2D Prior Art

FIG. 2C illustrates that fractures 228A have been formed in the subsurface formation 210 along Zone A. Proppant is now seen residing in an annular region along Zone A. Thus, something of a gravel pack is formed.

In the completion method of the FIG. 2 series of drawings, the process of perforating and fracturing along Zone A is repeated in connection with Zones B and C. FIG. 2D illustrates that a second perforating gun 250 and a second plug 240B having been run into the wellbore 200. The gun 250 is placed along Zone B while the plug 240B is set adjacent packer 215B. Further, charges associated with the perforating gun 250 have been detonated, forming new perforations 225B along Zone B.

Figure 2E:
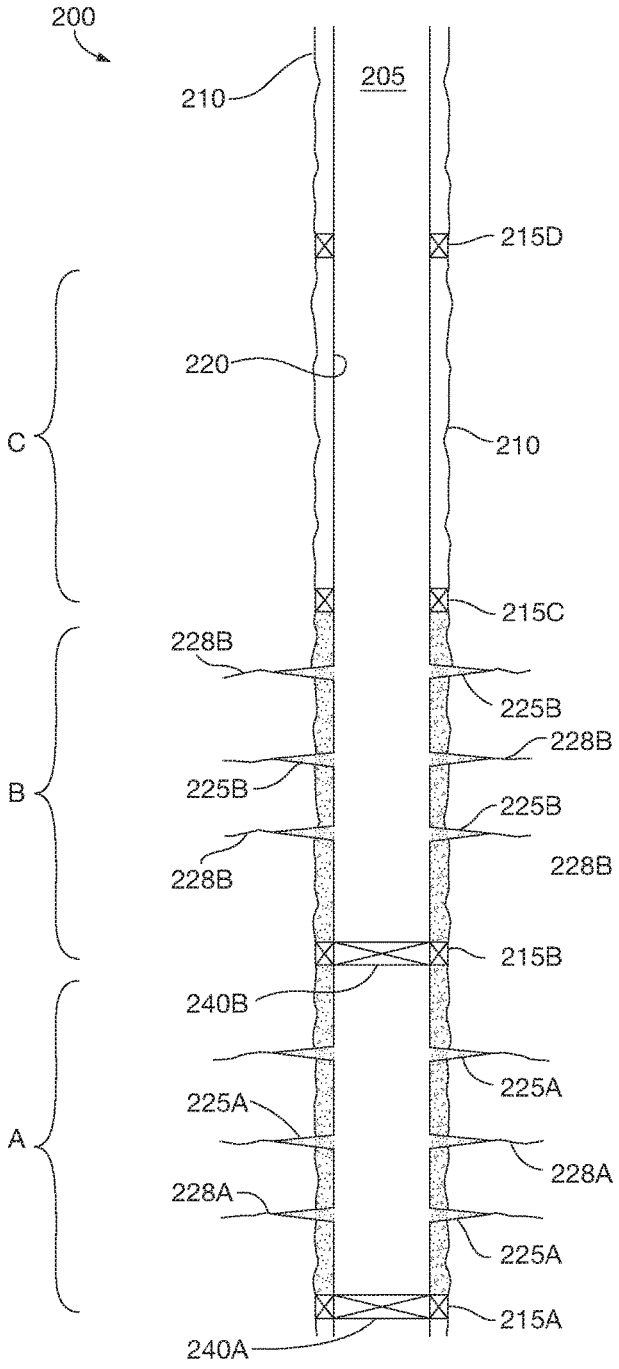
FIG. 2E Prior Art

Next, a fracturing fluid 245 is injected into the newly-formed perforations 225B. The fracturing fluid 245, with proppant, is injected under pressure in order to flow through the perforations 225B and into the formation 210. In this way, and as shown in FIG. 2E, new artificial fractures 228A are formed.

Figure 2F:
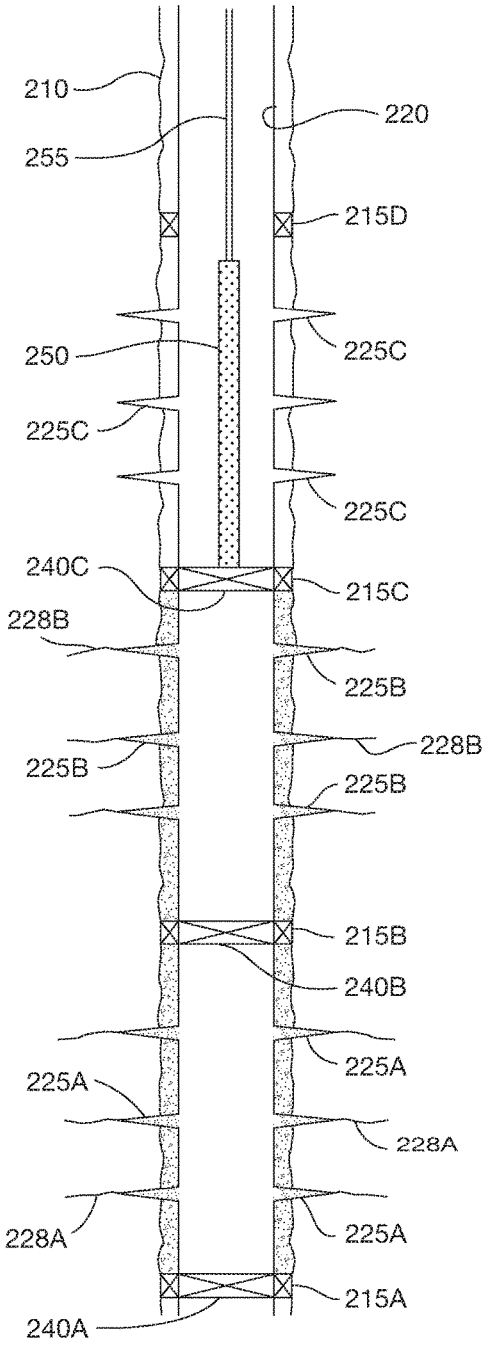
FIG. 2F Prior Art

The "Plug and Perf" process is repeated for Zone C. FIG. 2F illustrates that a third perforating gun 250 has been lowered into the bore 205 adjacent Zone C, and a third plug 240C has been set adjacent a packer intermediate Zones B and C. Further, the perforating gun 250 is shown forming perforations along Zone C. It is understood that fractures (not shown) are then created in the subsurface formation 210 along Zone C using a fracturing fluid (also not shown).

In order to perforate multiple zones, the "Plug and Perf" process requires the use of many separate plugs. Those plugs, in turn, must be drilled out before production operations may commence. Further, the "Plug and Perf" process requires large flush volumes and is also vulnerable to screen-out. In this respect, if a screen-out occurs along any zone during pumping, clean-out operations will need to be conducted. This is because the slurry cannot be completely pumped through the perforations and into the formation, or further down the wellbore, due to the presence of the bridge plug (such as plug 240C) immediately below the target zone.

Yet another completion procedure that has been used involves the placement of multiple fracturing sleeves (or "frac sleeves") along the production casing. This is known as "Ball and Sleeve" completion. The Ball and Sleeve technique is illustrated in FIGS. 3A through 3F. The FIG. 3 drawings present a series of side views of a lower portion of a wellbore 300. The wellbore 300 is undergoing a completion procedure that uses frac sleeves 321 in stages.

Figure 3A:
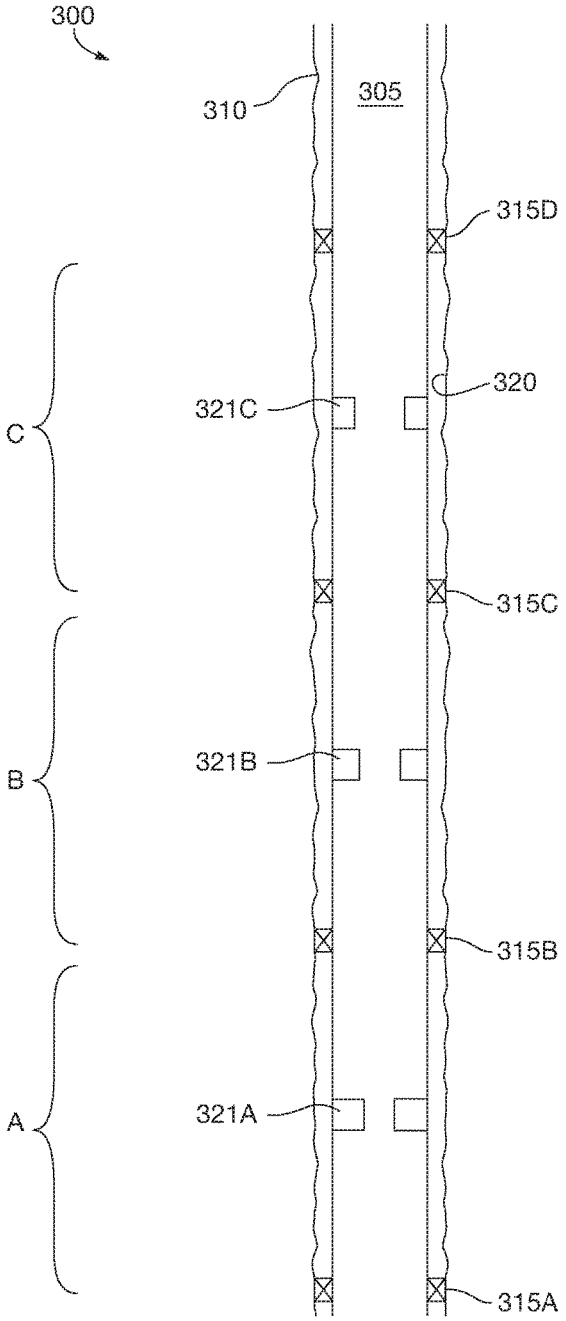
FIG. 3A Prior Art
FIGS. 3A through 3F present a series of side views of a lower portion of a wellbore. The wellbore is undergoing a completion procedure that uses perforating guns, fracturing sleeves and dropped balls, in stages. This is a known procedure.

First, FIG. 3A introduces the wellbore 300. The wellbore 300 is identical to the wellbore 100 of FIG. 1A. The wellbore 300 is lined with a string of production casing 320 that provides a bore 305 for the transport of fluids into and out of the wellbore 300. Annular packers 315A, 315B, 315C, 315D are placed along the casing 320 to isolate selected subsurface zones. The zones are identified as "A," "B" and "C."

In the completion processes shown in the FIG. 1 and the FIG. 2 series, each of Zones A, B, and C is sequentially perforated. However, in the completion process of the FIG. 3 series, frac sleeves 321A, 321B, 321C are used. The frac sleeves 321A, 321B, 321C are sequentially opened using balls 323A, 323B, 323C. This causes ports to be exposed along the production casing 320.

Figure 3B:
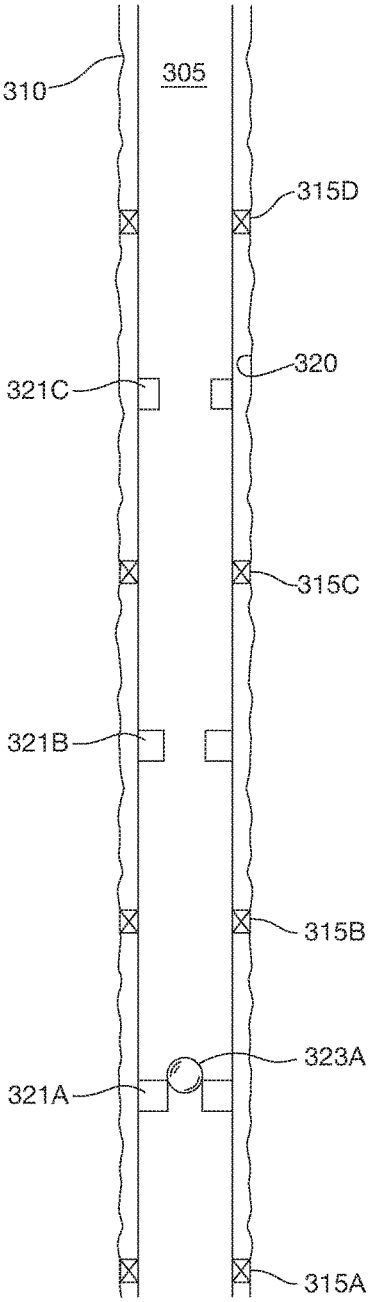
FIG. 3B Prior Art

Looking now at FIG. 3B, it can be seen that frac sleeve 321A has been placed along Zone A. A ball 323A has been dropped into the wellbore 300 and landed onto a seat associated with the frac sleeve 321A.

Figure 3C:
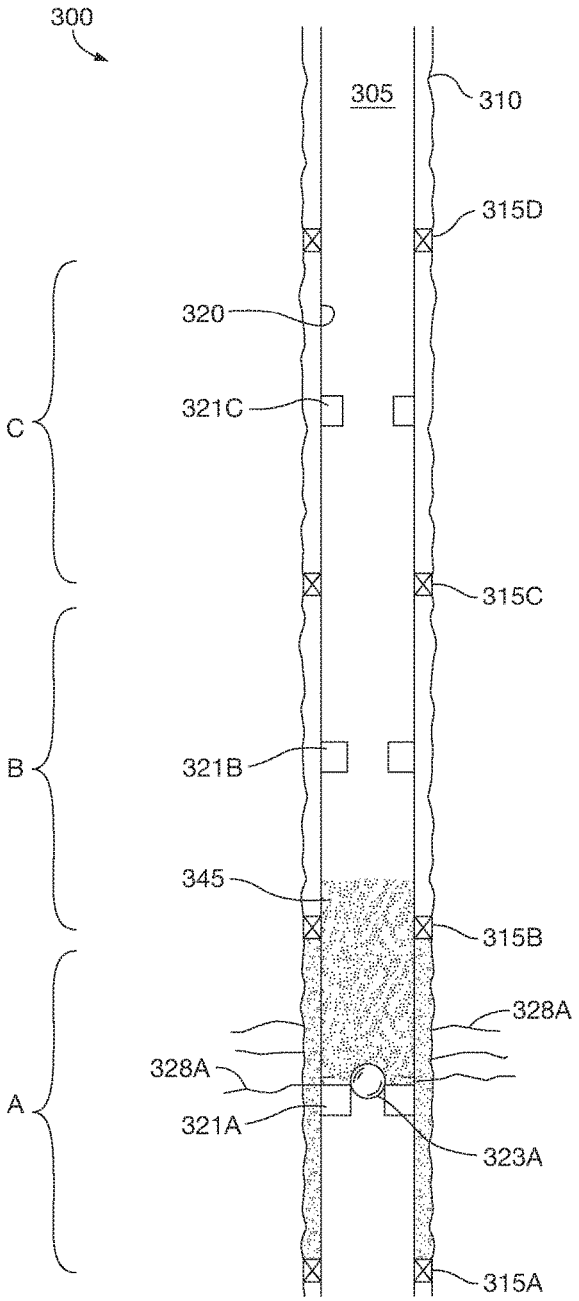
FIG. 3C Prior Art
Figure 3D:
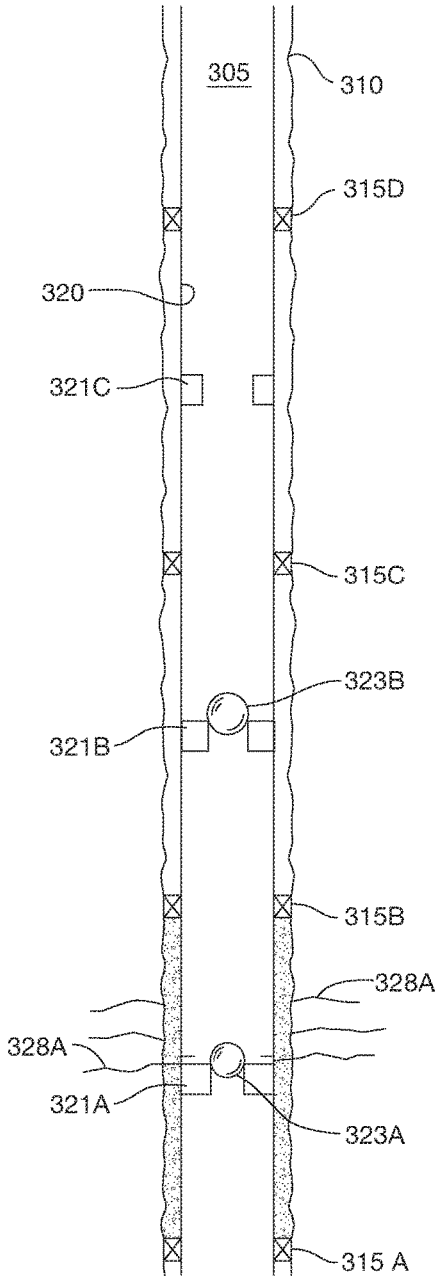
FIG. 3D Prior Art

FIG. 3C illustrates that hydraulic pressure has been applied to open the fracturing sleeve 321A. This is done by pumping a fracturing fluid 345 into the bore 305. As shown in FIG. 3C, the fracturing fluid 345 flows through the frac sleeve 321A, into the annular region between the production casing 320 and the surrounding subsurface formation 310, and into the formation 310 itself. Fractures 328A are being induced in the subsurface formation 310 along Zone A. Additionally, proppant is seen now residing in the annular region along Zone A.

In the completion method of the FIG. 3 series of drawings, the process of opening a sleeve and fracturing along Zone A is repeated in connection with Zones B and C. FIG. 3D illustrates that a second ball 323B has been dropped into the wellbore 300 and landed on a sleeve 321B. The sleeve 321B resides along Zone B.

Figure 3E:
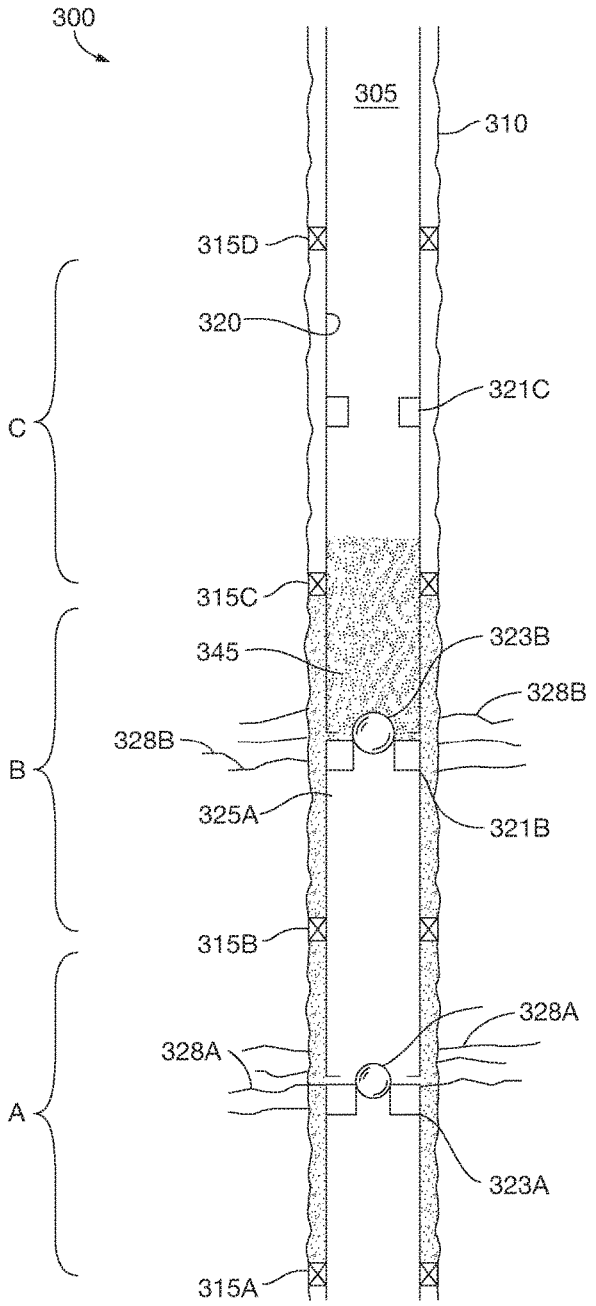
FIG. 3E Prior Art

FIG. 3E illustrates that hydraulic pressure has been applied to open the fracturing sleeve 321B. This is done by pumping a fracturing fluid 345 into the wellbore 300. Fractures are being induced in the subsurface formation 310 along Zone B. Proppant is seen residing now in an annular region along Zone B.

Figure 3F:
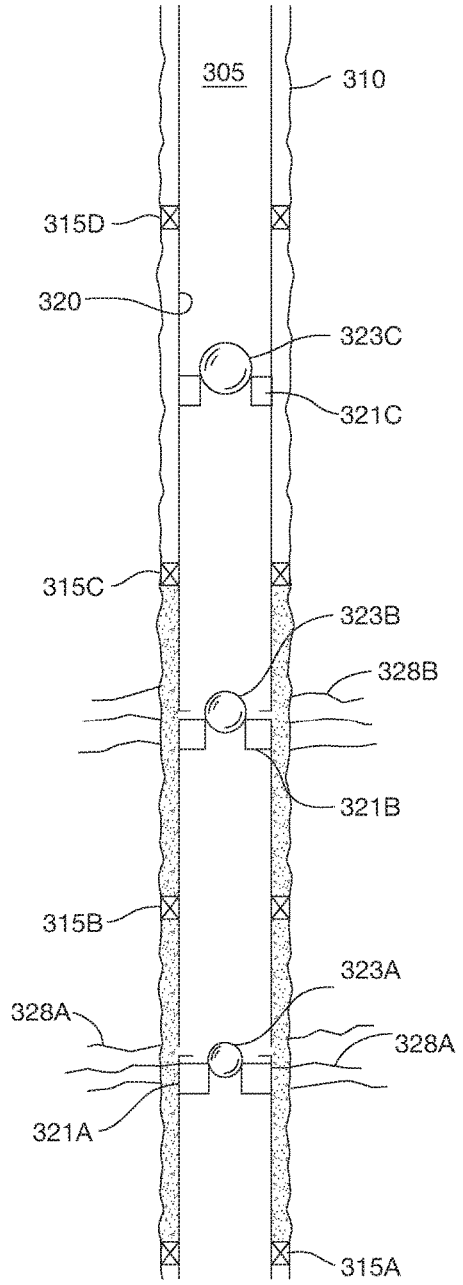
FIG. 3F Prior Art

The "Ball and Sleeve" process is repeated for Zone C. FIG. 3F illustrates that a third ball 323C has been dropped into the bore 305. The ball 323C has landed onto the frac sleeve 321C adjacent Zone C. It is understood that fractures (not shown) are then created in the subsurface formation 310 along Zone C.

The use of the sleeves 321A, 321B, 321C as shown in the FIG. 3 series reduces the flush volumes needed for completion. This, in turn, reduces the environmental impact. At the same time, the use of multiple sleeves creates a higher hardware risk and a higher risk of screen-out. If a screen-out occurs along any zone during pumping, clean-out operations will need to be conducted. This is because the slurry cannot be completely pumped through the perforations and into the formation, due to the presence of the sealed sleeve.

As the need for "pinpoint stimulation" has gained recognition, the number of stages may increase in the future for a given well length. However, experience with single zone stimulation has shown that as the wellbore is divided into smaller treated segments, the risk of screen-out increases. This means that the chance of pumping into easily treatable rock decreases. Recovery from screen-out upset for a frac-sleeve-only completion is very costly and usually involves well intervention and removal (i.e., destruction) of the hardware placed in the well during drilling operations.

For these and perhaps other reasons, it is desirable to modify the procedures presented in the processes of the FIG. 1 series, the FIG. 2 series, and the FIG. 3 series. Specifically, it is desirable to replace the wellbore plugs and sleeves with a valve that creates a fluid barrier, but wherein the fluid barrier can be selectively removed using increased pumping pressures to expose a port through the production casing. In this way, the slurry may be pumped through the then-exposed port. This enables the continuous pumping of fracturing fluids in the wellbore even when a screen-out occurs.

Various methods for providing a valve in the wellbore that removes the barrier to fluid flow downhole are provided and are described below.

FIGS. 4A through 4F present a series of side views of a lower portion of a wellbore 400. The wellbore 400 is undergoing a completion procedure that includes perforation and fracturing of at least one zone of interest. The wellbore 400 defines a bore 405 that has been formed through a subsurface formation 410. In the illustrative FIG. 4 series, the wellbore 400 is being completed in a horizontal orientation.

Figure 4A:
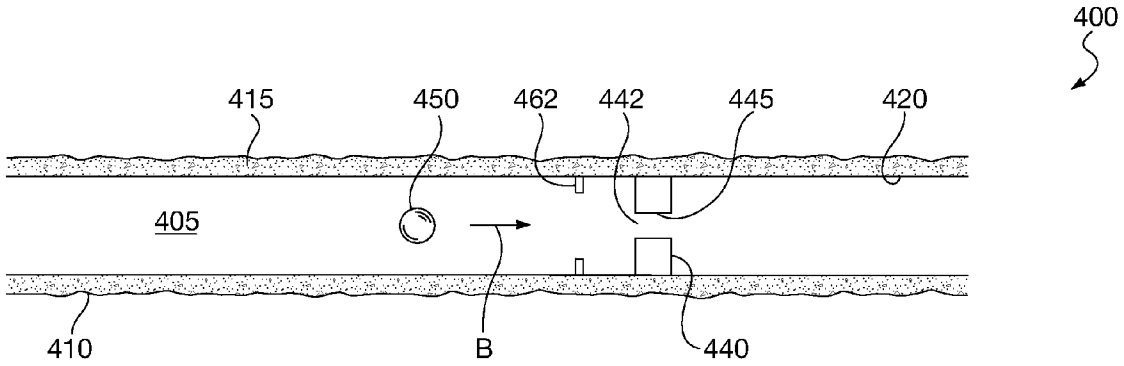
FIGS. 4A through 4F present a series of side views of a lower portion of a wellbore. The wellbore is undergoing a completion procedure that uses a valve, wherein actuating or moving the valve exposes a port along the production casing in a novel application.

FIG. 4A introduces the wellbore 400. The wellbore 400 is being completed with a string of production casing 420. The production casing 420 represents a series of steel pipe joints threadedly connected, end-to-end. The production casing 420 provides path for fluids into and out of the wellbore 400.

An annular region 415 resides between the production casing 420 and the surrounding rock matrix of the subsurface formation 410. The annular region 415 is filled with cement as is known in the art of drilling and completions. Where so-called swell-packers are used in the annular region 415 (see, for example, packers 115A, 115B, 115C, and 115D of the FIG. 1 set of drawings), the annular region 415 would not be cemented.

A frac sleeve 440 has been placed along the production casing 420. The frac sleeve 440 defines a hydraulically-actuated valve. This may be, for example, the Falcon Hydraulic-Actuated Valve of Schlumberger limited, of Sugar Land, Tex. The frac sleeve 440 includes a seat 442. The seat 442 which is dimensioned to receive a ball 450. In the view of FIG. 4A, the ball 450 has been dropped and is traveling down the wellbore 400, as indicated by Arrow B, towards the seat 442. Upon landing on the seat 442, the ball 450 will seal a through-opening 445 in the sleeve 440.

As shown in FIG. 4A, the wellbore 400 also includes a baffle seat 462. The baffle seat 462 defines a sub that is threadedly connected in-line with the production casing 420. The baffle seat 462 is dimensioned to receive a rupture disc, shown in FIGS. 4C and 4D at 460.

Figure 4B:
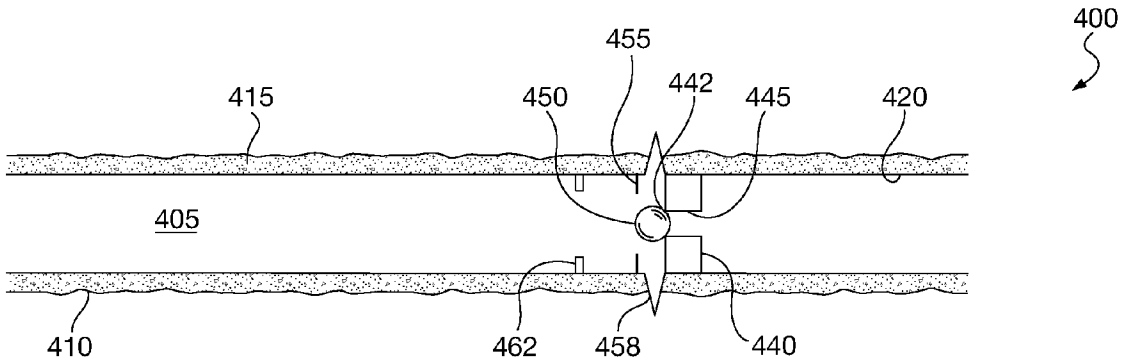

FIG. 4B presents a next view of the wellbore 400. Here, the ball 450 has landed on the seat 442 of the frac sleeve 460. The ball 450 provides a substantial pressure seal, creating a fluid barrier in the bore 405.

FIG. 4B also illustrates that the frac sleeve 440 has been moved. This means that pressure has been applied by the ball 450 against the seat 462, causing the sleeve 440 to shift, thereby exposing one or more ports 455. Pressure is applied by the injection of fluid into the wellbore and the application of fluid pressure using pumps (not shown) at the surface.

It can also be seen that some degree of fracturing has taken place. At least one small fracture 458, or "mini-fracture," has been created in the subsurface formation 410 as a result of the injection of fluids under pressure. Preferably, the fluid is a brine or other aqueous fluid that invades the near-wellbore region.

Figure 4C:
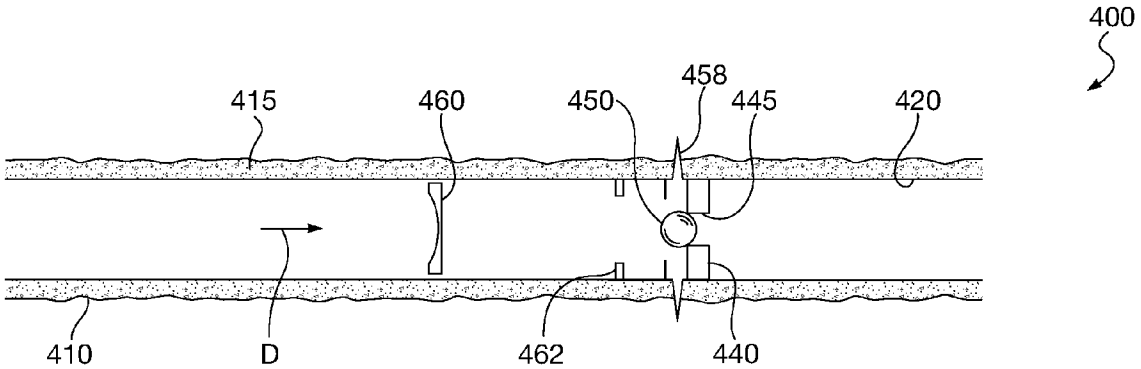
Figure 4D:
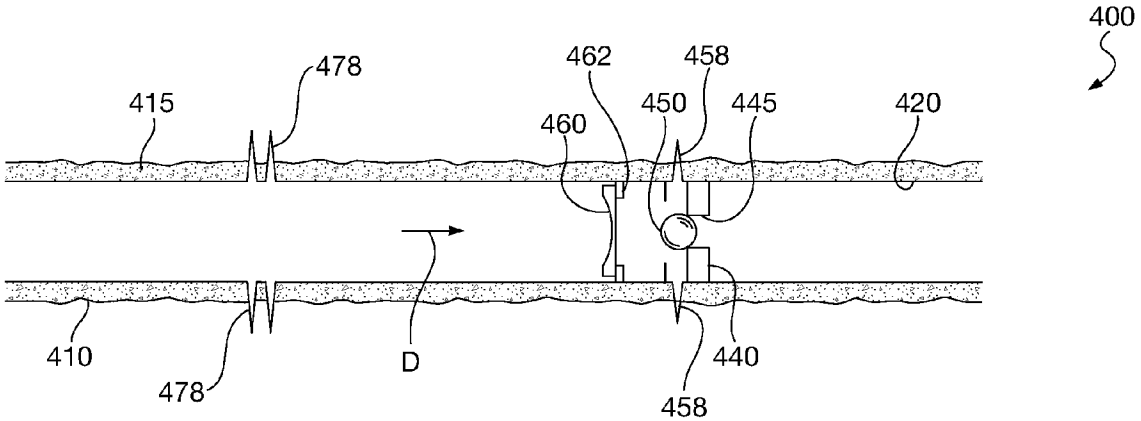

Referring now to FIGS. 4C and 4D together, FIG. 4C illustrates the placement of a rupture disc 460 in the bore 405. The rupture disc 460 is being pumped downhole as indicated by Arrow D. In FIG. 4D, the rupture disc 460 has landed on the baffle seat 462. The baffle seat 462 resides proximate the frac sleeve 440 and just above the newly-exposed flow ports 455.

The rupture disc 460 includes a diaphragm or other pressure-sensitive device. The pressure device has a burst rating. When the pressure in the bore 405 goes above the burst rating, the disc 460 will rupture, permitting a flow of fluids there through. Until bursting, the disc 460 creates a barrier to fluid flow through the bore 405.

Also seen in FIG. 4D is a new set of perforations 478. The perforations 478 have been formed through the casing 420 and into the subsurface formation 410. The perforations were shot using a perforating gun (not shown). The perforating gun may be a select fire gun that fires, for example, 16 shots. The gun has associated charges that detonate in order to cause shots to be fired from the gun and into the surrounding production casing 420. Typically, the perforating gun 420 contains a string of shaped charges distributed along the length of the gun 420 and oriented according to desired specifications.

Alternatively, the perforating gun may be part of an autonomous perforating gun assembly, such as that described in U.S. Patent Publ. No. 2013/0062055. The autonomous perforating gun assembly is designed to be released into the wellbore 400 and to be self-actuating. In this respect, the assembly does not require a wireline and need not otherwise be mechanically tethered or electronically connected to equipment external to the wellbore. The delivery method may include gravity, pumping, or tractor delivery.

The autonomous perforating gun assembly generally includes a perforating gun, a depth locator, and an on-board controller. The depth locator may be, for example, a casing collar locator that measures magnetic flux as the assembly falls through the wellbore. Anomalies in magnetic flux are interpreted as casing collars residing along the length of the casing string. The assembly is aware of its location in the wellbore by counting collars along the casing string as the assembly moves downward through the wellbore.

The on-board controller is programmed to send an actuation signal. The signal is sent to the perforating gun when the assembly has reached a selected location along the wellbore. In the case of FIG. 4B, that location is a depth that is above the frac sleeve 440 and along a zone of interest. To confirm location, the controller may be pre-programmed with a known casing or formation log. The controller compares readings taken in real time by the casing collar locator or other logging tool with the pre-loaded log.

The autonomous assembly may also include a power supply. The power supply may be, for example, one or more lithium batteries, or battery pack. The power supply will reside in a housing along with the on-board controller. The perforating gun, the location device, the on-board controller, and the battery pack are together dimensioned and arranged to be deployed in a wellbore as an autonomous unit.

The autonomous assembly defines an elongated body. The assembly is preferably fabricated from a material that is frangible or "friable." In this respect, it is designed to disintegrate when charges associated with the perforating gun are detonated.

The completion assembly is preferably equipped with a special tool-locating algorithm. The algorithm allows the tool to accurately track casing collars en route to a selected location downhole. U.S. patent application Ser. No. 13/989,726, filed on 24 May 24 2013, discloses a method of actuating a downhole tool in a wellbore. That patent application is entitled "Method for Automatic Control and Positioning of Autonomous Downhole Tools." The application was published as U.S. Patent Publ. No. 2013/0255939.

According to that U.S. Patent Publ. No. 2013/0255939, the operator will first acquire a CCL data set from the wellbore. This is preferably done using a traditional casing collar locator. The casing collar locator is run into a wellbore on a wireline or electric line to detect magnetic anomalies along the casing string. The CCL data set correlates continuously recorded magnetic signals with measured depth. More specifically, the depths of casing collars may be determined based on the length and speed of the wireline pulling a CCL logging device. In this way, a first CCL log for the wellbore is formed.

In practice, the first CCL log is downloaded into a processor which is part of the on-board controller. The on-board controller processes the depth signals generated by the casing collar locator. In one aspect, the on-board controller compares the generated signals from the position locator with a pre-determined physical signature obtained for wellbore objects from the prior CCL log.

The on-board controller is programmed to continuously record magnetic signals as the autonomous tool traverses the casing collars. In this way, a second CCL log is formed. The processor, or on-board controller, transforms the recorded magnetic signals of the second CCL log by applying a moving windowed statistical analysis. Further, the processor incrementally compares the transformed second CCL log with the first CCL log during deployment of the downhole tool to correlate values indicative of casing collar locations. This is preferably done through a pattern matching algorithm. The algorithm correlates individual peaks or even groups of peaks representing casing collar locations. In addition, the processor is programmed to recognize the selected location in the wellbore, and then send an activation signal to the actuatable wellbore device or tool when the processor has recognized the selected location.

In some instances, the operator may have access to a wellbore diagram providing exact information concerning the spacing of downhole markers such as the casing collars. The on-board controller may then be programmed to count the casing collars, thereby determining the location of the tool as it moves downwardly in the wellbore.

In some instances, the production casing may be pre-designed to have so-called short joints, that is, selected joints that are only, for example, 15 or 20 feet in length, as opposed to the "standard" length selected by the operator for completing a well, such as 30 feet. In this event, the on-board controller may use the non-uniform spacing provided by the short joints as a means of checking or confirming a location in the wellbore as the completion assembly moves through the casing.

In one embodiment, the method further comprises transforming the CCL data set for the first CCL log. This also is done by applying a moving windowed statistical analysis. The first CCL log is downloaded into the processor as a first transformed CCL log. In this embodiment, the processor incrementally compares the second transformed CCL log with the first transformed CCL log to correlate values indicative of casing collar locations.

It is understood that the depth locator may be any other logging tool. For example, the on-board depth locator may be a gamma ray log, a density log, a neutron log, or other formation log. In this instance, the controller is comparing readings in real time from the logging tool with a pre-loaded gamma ray or neutron log. Alternatively, the depth locator may be a location sensor (such as IR reader) that senses markers placed along the casing (such as an IR transceiver). The on-board controller sends the actuation signal to the perforating gun when the location sensor has recognized one or more selected markers along the casing.

In one embodiment, the algorithm interacts with an on-board accelerometer. An accelerometer is a device that measures acceleration experienced during a freefall. An accelerometer may include multi-axis capability to detect magnitude and direction of the acceleration as a vector quantity. When in communication with analytical software, the accelerometer allows the position of an object to be confirmed.

Additional details for the tool-locating algorithm are disclosed in U.S. Patent Publ. No. 2013/0255939, referenced above. That related, co-pending application is incorporated by reference herein in its entirety.

Figure 8:
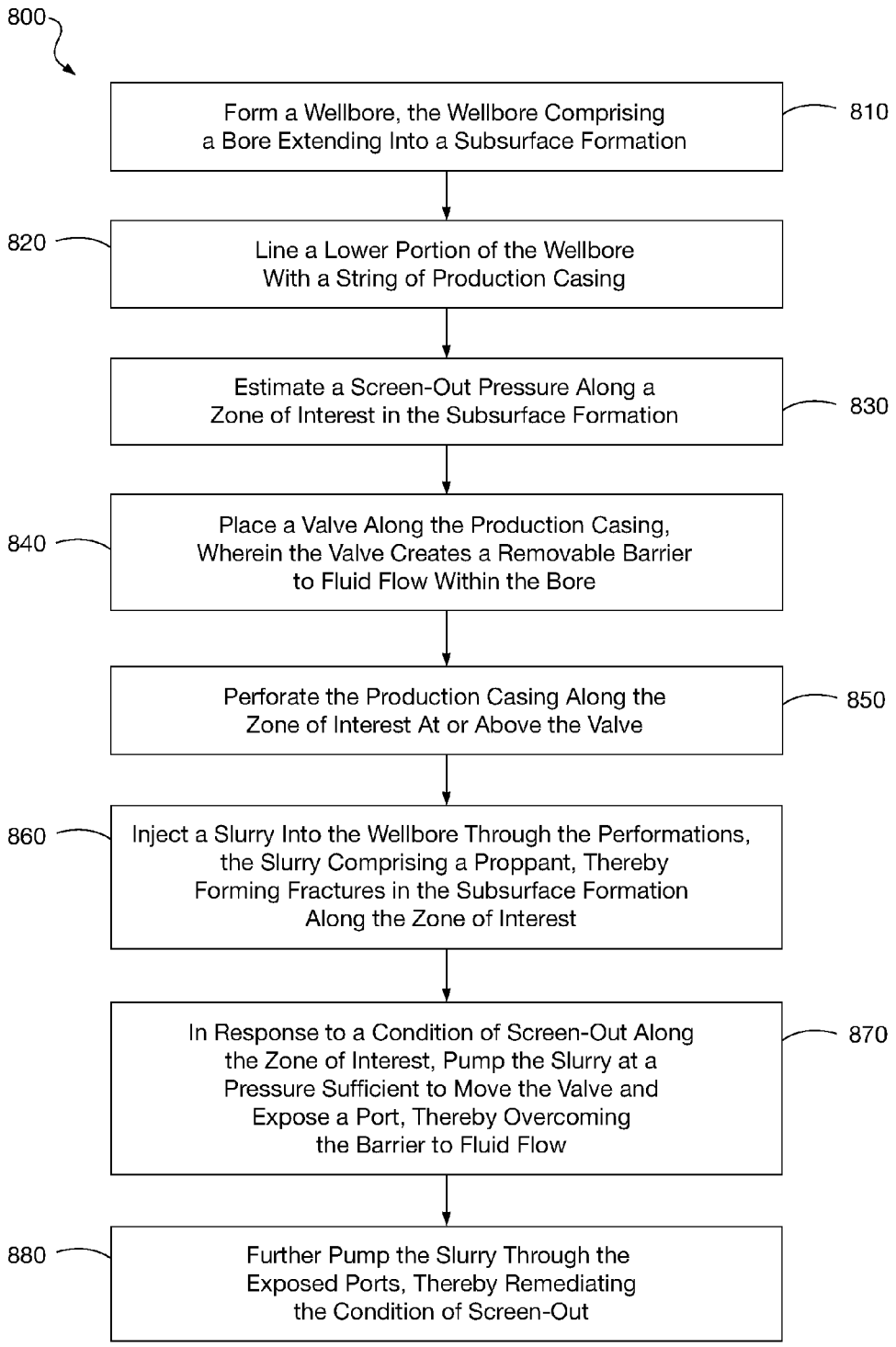
FIG. 8 is a flow chart illustrating steps for a method of completing a well, in one embodiment. The method uses a valve that may be actuated to expose a set of ports below perforations, thereby remediating a condition of screen-out.

In order to prevent premature actuation, a series of gates is provided. U.S. patent application Ser. No. 14/005,166 describes a perforating gun assembly being released from a wellhead. That application was filed on 13 Sep. 2013, and is entitled "Safety System for Autonomous Downhole Tool." The application was published as U.S. Patent Publ. No. 2013/0248174. FIG. 8 and the corresponding discussion of the gates in that published application are incorporated herein by reference.

Figure 4E:
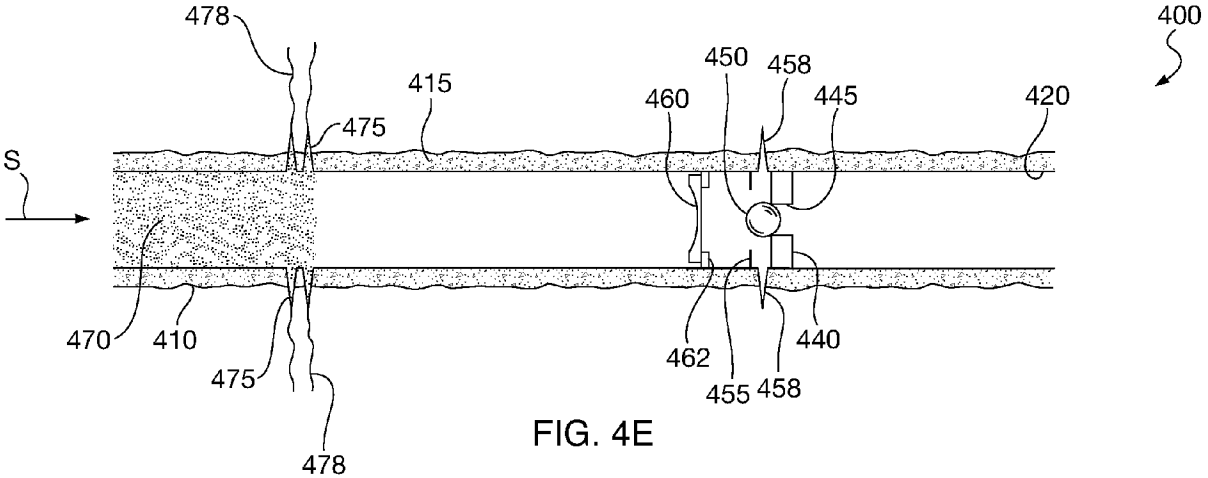

After perforations are shot, the operator begins a formation fracturing operation. FIG. 4E demonstrates the movement of slurry 470 through the bore 405. Slurry is pumped downhole as indicated by Arrows S. As the slurry 470 reaches the perforations, the slurry invades the subsurface formation 410, creating tunnels and tiny fractures 478 in the rock.

It is observed that slurry is prevented from moving down to the flow ports 458 in the frac sleeve 440 by the rupture disc 460. Of importance, the rupture disc 460 is designed to have a burst rating that is higher than an estimated formation parting pressure. Ideally, the operator or a completions engineer will pre-determine an anticipated formation parting pressure based on geo-mechanical modeling, field data, and/or previous experiences in the same field. A rupture disc having a burst rating sufficiently above the formation parting pressure is selected to avoid accidental break-through during pumping.

Figure 4F:
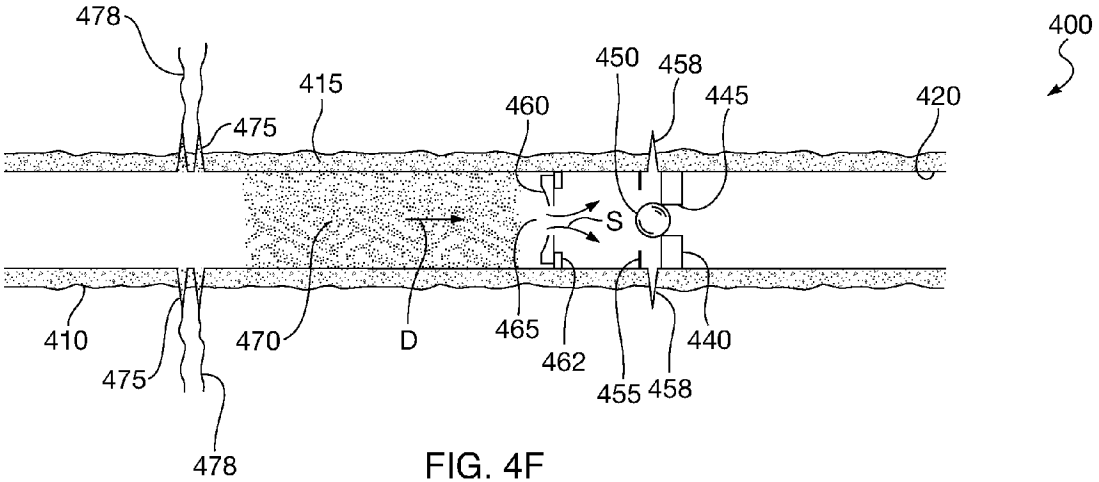

Finally, FIG. 4F illustrates that a condition of screen-out has occurred. Sand or other proppant material has become tightly packed in the perforations 475 and fractures 478, even to the point where additional slurry can no longer be pumped. This occurs when the aqueous (or other) carrier medium leaks off into the formation, leaving sand particles in place.

The operator at the surface will recognize that a condition of screen-out has occurred by observing the surface pumps. In this respect, pressure will quickly build in the wellbore, producing rapidly climbing pressure readings at the surface. Under conventional operations, the operator will need to back off the pump rate to prevent wellbore pressures from exceeding the burst ratings and maximum hoop and tensile stresses of the casing, and to prevent damage to surface valves. The operator may then hope flow back the well, using bottom hole pressure to try and push the proppant-laden slurry back out of the well and to the surface. In known procedures, if the velocity is not sufficient, the proppant will drop out in the casing and across the heel of the well, creating a bridge of proppant that must be removed mechanically before operations can continue. On the other hand, if the pressure is reduced too quickly at the surface, the high flow rate of proppant can cause significant abrasive damage to valves and piping as it flows through significantly smaller pipe.

In the novel method demonstrated by the FIG. 4 series of drawings, the problem of screen-out is self-remediating. In this respect, the excess pressure created by the pumping and by the hydrostatic head of the proppant-laden slurry during screen-out will prompt the diaphragm in the rupture disc 460 to burst. This fortuitous event has occurred in FIG. 4F.

It can be seen in FIG. 4F that a through-opening 465 has been created through the rupture disc 460. Slurry 470 remaining in the wellbore is now moving through the through-opening 465. Further, the slurry 470 is moving though the flow ports 455 of the frac sleeve 440. In this way, the problem of screen-out is remediated.

In the method of the FIG. 4 series of drawings, the rupture disc 460 serves as a valve. The valve "opens" in response to a wellbore pressure encountered during the screen-out. When the valve 460 opens, the barrier to fluid flow down the wellbore is removed, exposing the flow ports 455. This, in turn, relieves the excess wellbore pressure.

It is noted that the rupture disc 460 is actually an optional feature in the method of the FIG. 4 series. The method may be modified by removing the rupture disc 460 and just using the frac sleeve 440 as the valve that is opened. In this instance, the sleeve 440 is maintained in its closed position during the perf-and-frac operation, and only opens if higher wellbore pressures indicative of a screen-out occur. The result is that the flow ports 455 open in the step of FIG. 4E rather than in FIG. 4B.

Figure 5A:
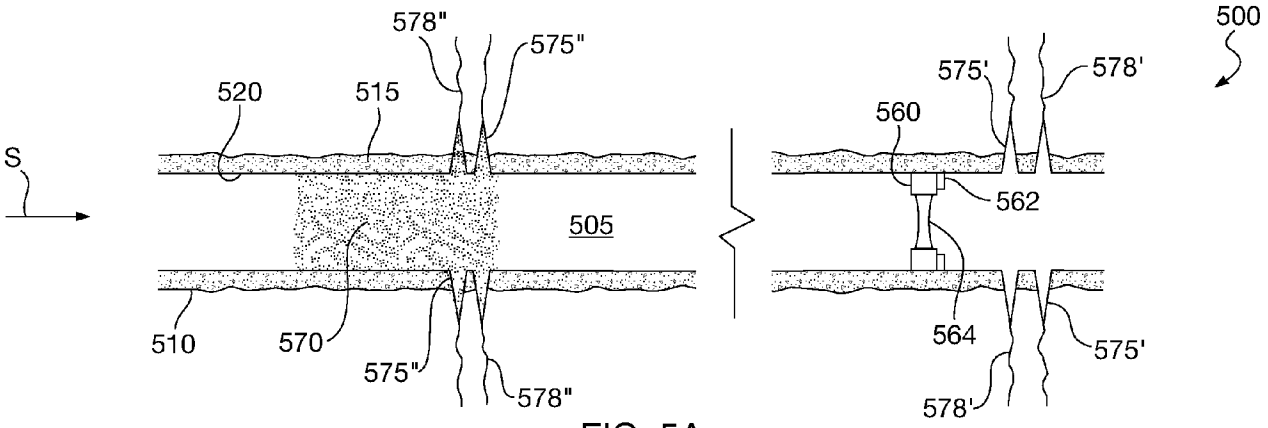
FIGS. 5A and 5B illustrate an alternate completion method for a perforated wellbore. Here, a rupture disc is again landed on a baffle seat. However, rather than using a sliding sleeve, the wellbore is separately perforated below the rupture disc.
Figure 5B:
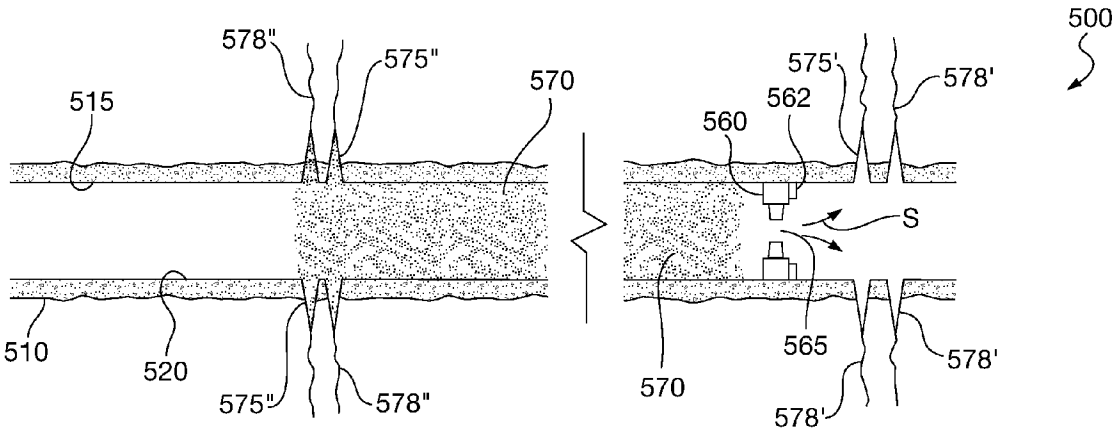

In another embodiment, a rupture disc is used without a frac sleeve. FIGS. 5A and 5B demonstrate such a method.

First, FIG. 5A illustrates a wellbore 500 undergoing completion. The wellbore 500 is being completed in a horizontal orientation. The completion of wellbore 500 includes a string of production casing 520 cemented in place within a surrounding subsurface formation 510. Optional cement is shown in an annular area 515 around the casing 520.

In this view, the wellbore 500 has been completed along two zones of interest, indicated by separate perforations at 575' and 575". The lower zone of interest, indicated by perforations at 575', has been fractured. Fractures are shown somewhat schematically at 578'. The upper zone of interest, indicated by perforations 575", has also been fractured. Fractures are shown there at 578".

In FIG. 5A, a rupture disc 560 has been pumped down into the bore 505. The disc 560 has landed on a baffle seat 562. The baffle seat 562 is located above the lower zone of interest and the corresponding perforations 575'. In this way, the rupture disc 560 resides between the lower 575' and the upper 575" sets of perforations.

The rupture disc 560 includes a pressure diaphragm 564. The diaphragm 564 has a burst pressure that is higher than an anticipated formation fracturing pressure for the upper perforations 575". Specifically, the disc 560 is designed to rupture in the event of a screen-out during fracturing of the upper perforations 575". Thus, the burst rating for the rupture disc 560 and its diaphragm 564 is designed to approximate a pressure that would be experienced in the wellbore 500 in the event of a screen-out.

FIG. 5B demonstrates that a condition of screen-out has arisen. It can be seen that slurry 570 has moved past the upper perforations 575 and has moved down the bore 505 towards the lower set of perforations 575'. A buildup of pressure due to screen-out has caused the pressure diaphragm 564 to rupture, creating a new through-opening 565 in the rupture disc 560. Slurry 570 will proceed to the lower set of perforations 575', as indicated by Arrows S. Thus, the rupture disc 560 serves essentially as a relief valve.

Figure 5C:
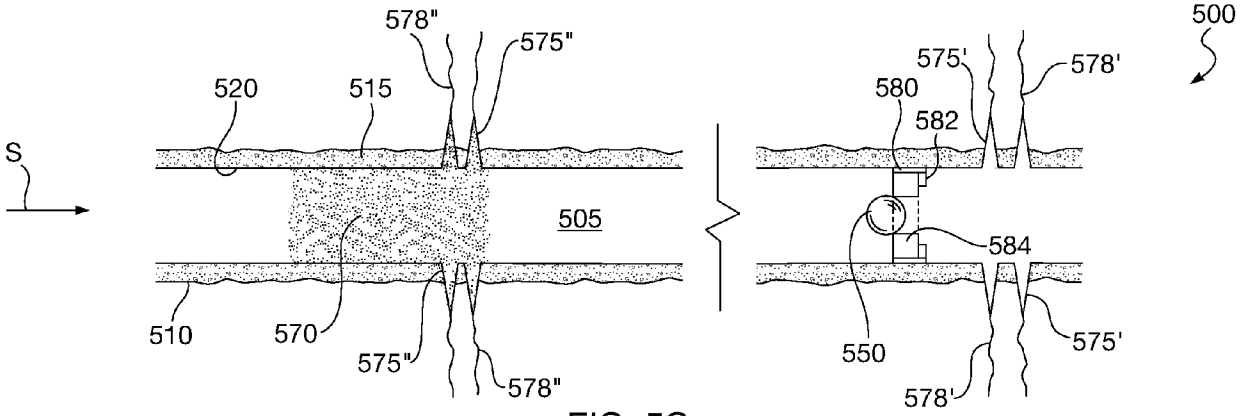
FIG. 5C presents the wellbore with a ball landed in a frac plug. The wellbore has received perforations both above and below the frac plug. The subsurface formation is being fractured through the upper perforations.
Figure 5D:
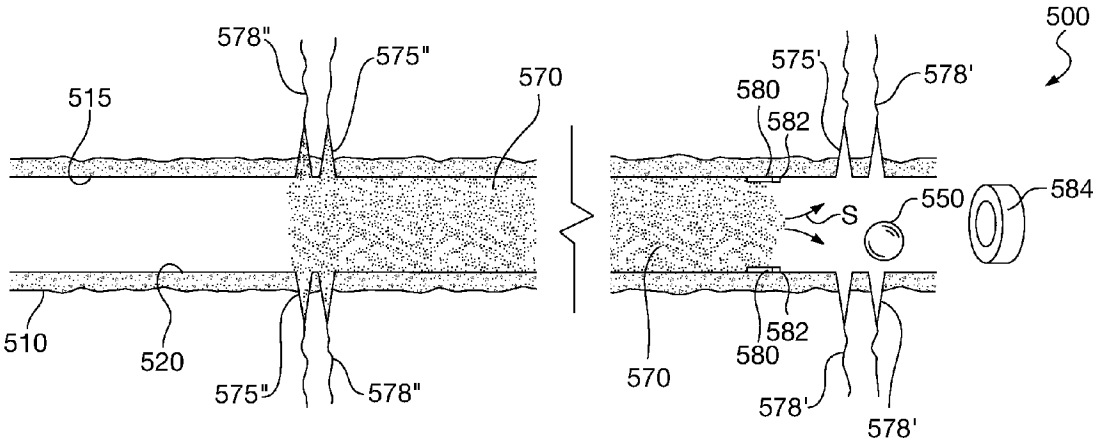
FIG. 5D is another view of the wellbore of FIG. 5C. Fracturing fluid continues to be pumped down the wellbore in response to a condition of screen-out at the upper perforations. Pumping pressure has caused a seat along the frac plug to be sheared off, allowing slurry to move down the wellbore and towards the lower perforations.

In another embodiment, a frac plug is used that may shear off in response to a condition of screen-out. FIGS. 5C and 5D demonstrate such a method.

First, FIG. 5C illustrates the same wellbore 500 as in FIG. 5A undergoing completion. The wellbore 500 is being completed in a horizontal orientation. The completion of wellbore 500 includes a string of production casing 520 cemented in place within a surrounding subsurface formation 510. Optional cement is shown in an annular area 515 around the casing 520.

In FIG. 5C, a frac plug 580 has been placed along the casing 520. The frac plug 580 may be, for example, Halliburton's composite frac plug with caged ball and seat. The frac plug 580 includes a seat 584 dimensioned to receive a ball 550. A ball 550 has landed on the seat 584 above the lower zone of interest and the corresponding perforations 575'. In this way, the ball 550 resides between the lower 575' and the upper 575" sets of perforations.

The frac plug 580 includes shear pins 582 designed to release in response to a fluid pressure within the bore 505 that is greater than a screen-out pressure during fracturing of the upper perforations 575". This is a pressure that is higher than an anticipated formation fracturing pressure for the upper perforations 575". The seat 584 is held with shear pins which release the valve (ball 550 and seat 584) when the designed pressure differential is exceeded, most likely caused by screen-out of proppant into the upper formation 575".

FIG. 5D demonstrates that a condition of screen-out has arisen. It can be seen that slurry 570 has moved past the upper perforations 575" and has moved down the bore 505 towards the lower set of perforations 575'. A build-up of pressure due to screen-out has caused the pins 582 along the frac plug 580 to shear, allowing slurry 570 to proceed to the lower set of perforations 575', as indicated by Arrows S. The ball 550 and seat 584 are falling in the wellbore 500. Thus, the ball-and-seat arrangement of the releasable frac plug 580 serves essentially as a relief valve.

Figure 6A:
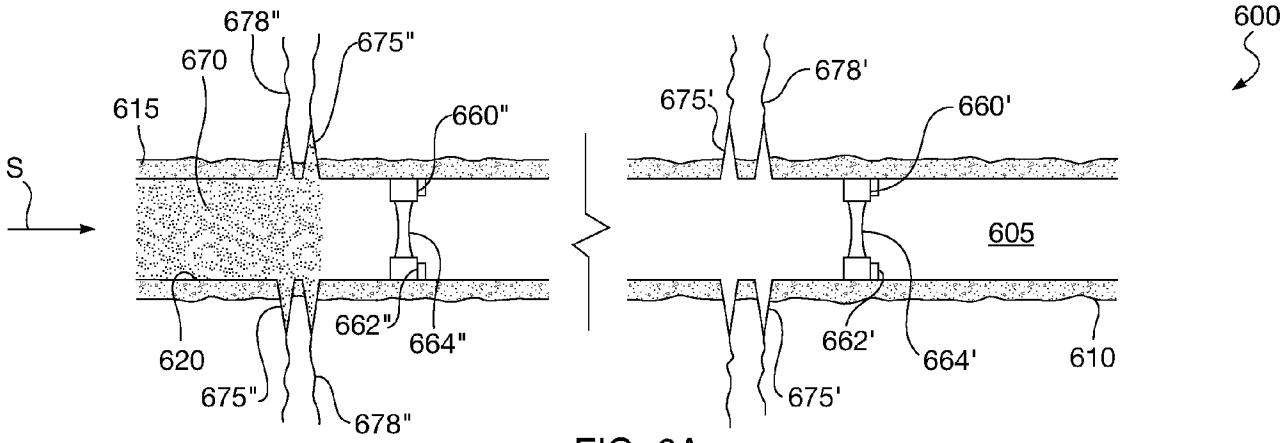
FIGS. 6A and 6B illustrate another alternate completion method for a perforated wellbore. Here, a rupture disc is again landed on a baffle seat. Additionally, a second lower rupture disc is landed on a baffle seat below a lower set of perforations.
Figure 6B:
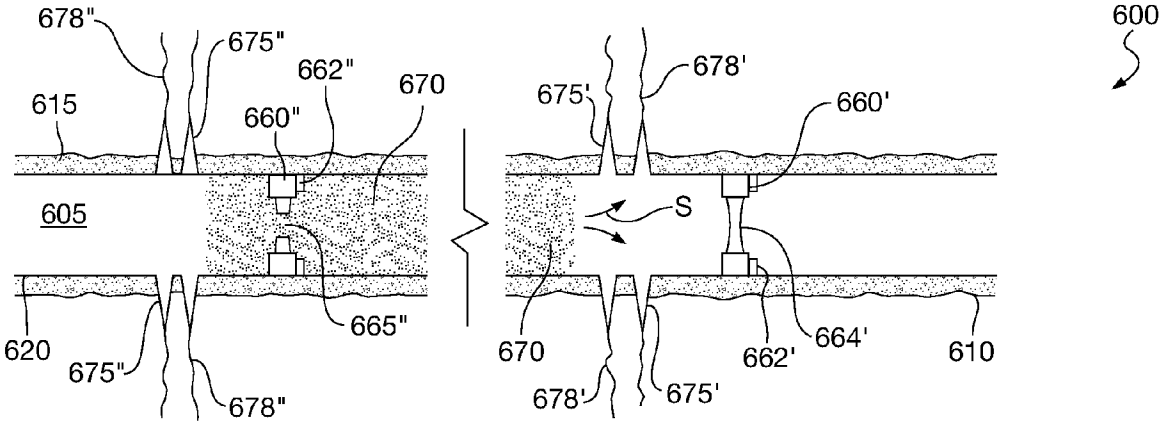

In another embodiment, two rupture discs are used between the upper and lower zones of interest, without a frac sleeve. FIGS. 6A and 6B demonstrate such a method.

First, FIG. 6A illustrates a wellbore 600 undergoing completion. The wellbore 600 is being completed in a horizontal orientation. The completion of wellbore 600 includes a string of production casing 620 cemented in place within a surrounding subsurface formation 610. Optional cement is shown in an annular area 615 around the casing 620.

In FIG. 6A, the wellbore 600 has been completed along two zones of interest, indicated by separate perforations at 675' and 675". The lower zone of interest, indicated by perforations at 675', has been fractured. Fractures are shown somewhat schematically at 678'. The upper zone of interest, indicated by perforations 675", has also been fractured. Fractures are shown there at 678".

In FIG. 6A, an upper rupture disc 660" has been pumped down into the bore 605. The disc 660" has landed on an upper baffle seat 662". The upper baffle seat 662" is located above the lower zone of interest and the corresponding perforations 675'. In this way, the rupture disc 660" resides between the upper 675" and the lower 675' sets of perforations.

The upper rupture disc 660" includes a pressure diaphragm 664". The diaphragm 664" has a burst pressure that is higher than an anticipated formation fracturing pressure for the formation 610. Specifically, the disc 660" is designed to rupture in the event of a screen-out during fracturing of the upper perforations 675". Thus, the burst rating for the rupture disc 660" and its diaphragm 664" is designed to approximate a pressure that would be experienced in the wellbore 600 in the event of a screen-out.

The wellbore 600 also includes a lower rupture disc 660'. The lower rupture disc 660' has been previously pumped down into the bore 605 ahead of the upper rupture disc 660". The lower rupture disc 660' is dimensioned to pass through the upper baffle seat 662" and land on a lower baffle seat 662'. The lower baffle seat 662' is located below the lower zone of interest and the corresponding perforations 675'.

The lower rupture disc 660' also includes a pressure diaphragm 664'. The diaphragm 664' has a burst pressure that is higher than the burst rating for the upper rupture disc 660". Specifically, the disc 660' is designed to withstand even an anticipated screen-out during fracturing of the upper perforations 675".

FIG. 6B demonstrates that a condition of screen-out has arisen. It can be seen that slurry 670 has moved past the upper perforations 675" and has moved down the bore 605 towards the lower set of perforations 675'. A buildup of pressure due to screen-out has caused the pressure diaphragm 664' in the upper rupture disc 660" to rupture, creating a new through-opening 665" in the rupture disc 660". The lower rupture disc 660' remains in-tact, and forces the slurry 670 to enter the lower set of perforations 675', as indicated by Arrows S.

As can be seen, the first rupture disc 660" again serves essentially as a relief valve.

Figure 7A:
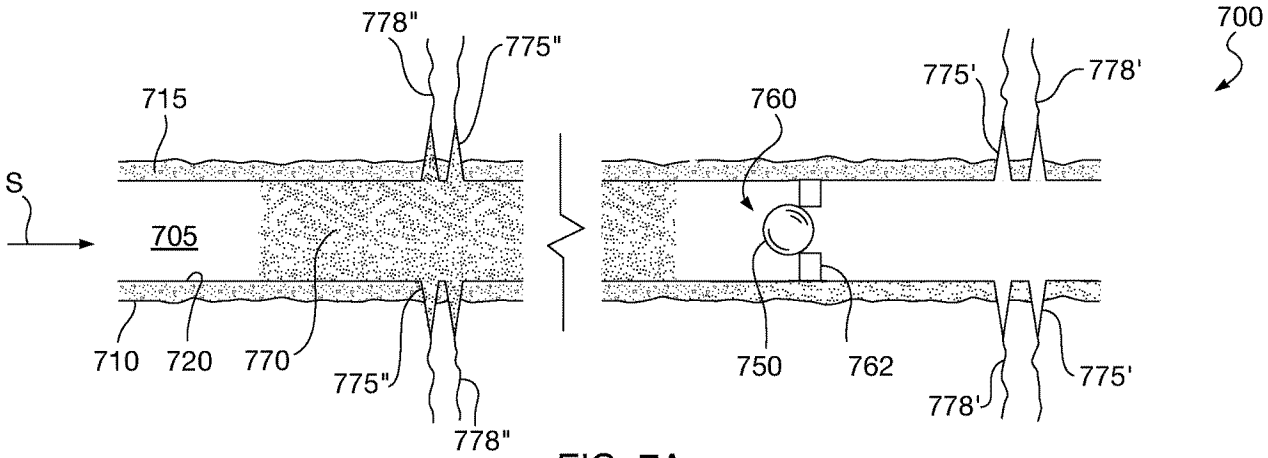
FIGS. 7A and 7B illustrate an alternate completion method for a perforated wellbore. Here, a ball-and-seat valve is used in the wellbore. The wellbore is separately perforated below the valve.
Figure 7B:
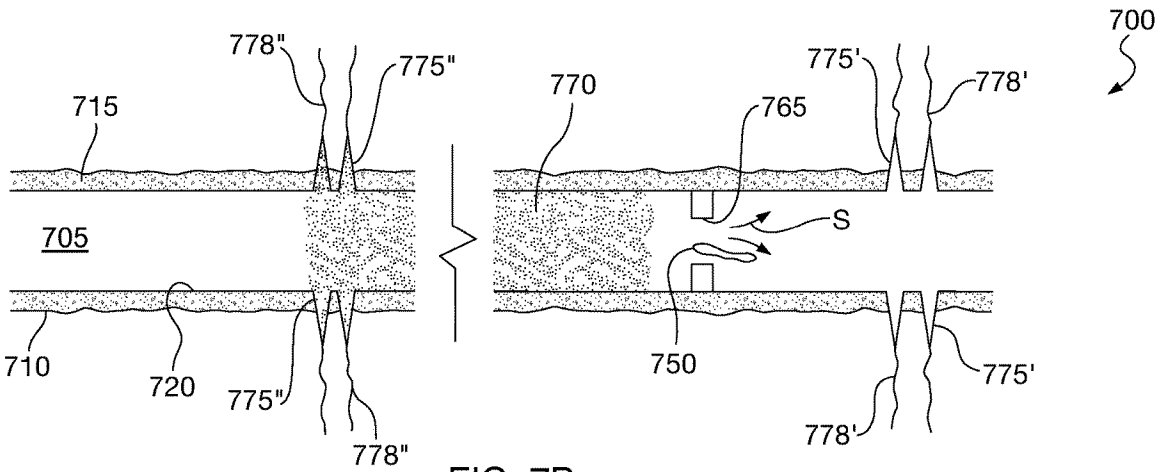

In another embodiment, a frac plug having a removable ball is used without a frac sleeve. FIGS. 7A and 7B demonstrate such a method.

First, FIG. 7A illustrates another wellbore 700 undergoing completion procedures. The wellbore 700 is being completed in a horizontal orientation. The completion of wellbore 700 includes a string of production casing 720 cemented in place within a surrounding subsurface formation 710. Optional cement is shown in an annular area 715 around the casing 620.

In the view of FIG. 7A, the wellbore 700 is again being completed along two zones of interest, indicated by separate perforations at 775' and 775". The lower zone of interest, indicated by perforations at 775', has been fractured. Fractures are shown somewhat schematically at 778'. The upper zone of interest, indicated by perforations 775", has also been fractured. Fractures are shown there at 778".

In FIG. 7A, a ball-and-seat valve 760 has been placed along the subsurface formation 710. The valve 760 comprises a sub that is threadedly connected in-line with the production casing 720. The valve 760 has a seat 762 that is dimensioned to receive a ball 750. It can be seen in FIG. 7A that a ball 750 been dropped into the bore 705 and has landed on the seat 762, thereby creating a pressure seal that prevents fluid flow further down the bore 705.

The ball-and-seat valve 760 is located above the lower zone of interest and the corresponding perforations 775'. At the same time, the valve 760 resides below the upper zone of interest and the corresponding perforations 775".

The ball 750 is uniquely fabricated from a material than collapses in response to pressure. Rather than having a burst pressure, it has a collapse pressure. The collapse pressure is the pressure at which the ball 750 will collapse or break or dissolve. In the arrangement of FIGS. 7A and 7B, this pressure is higher than an anticipated formation fracturing pressure for the subsurface formation 710. Specifically, the ball 750 is designed to collapse in the event of a screen-out during fracturing of the upper perforations 775". Thus, the collapse rating for the ball 750 is designed to approximate a pressure that would be experienced in the wellbore 700 in the event of a screen-out.

In FIG. 7A, a slurry 770 is being pumped down the bore 705. This forms the upper set of fractures 778". However, FIG. 7B demonstrates that a condition of screen-out has arisen at the level of these fractures 778". It can be seen that slurry 770 has moved past the upper perforations 775" and has moved down the bore 705 towards the lower set of perforations 775'. A buildup of pressure due to screen-out has caused the ball (750) to collapse, crumble, disintegrate, and/or dissolve, creating a new through-opening 765 in seat 762. Slurry 770 will proceed to the lower set of perforations 775' as indicated by Arrows S. Thus, the ball-and-seat valve 760 serves essentially as a relief valve.

Beneficially for this embodiment, the downstream pressure need not be known by the completions engineer (or operator) in order to define the optimal pressure to create the leak path. The treatment pressure acts only on the pressure internal to the ball 750, which causes it to collapse or destruct. This, in turn, allows fluids to bypass the collapsed ball 750.

The methods of the present invention can be presented in flow chart form. FIG. 8 represents a flow chart showing steps for a method 800 of completing a well, in one embodiment. In connection with the method, a condition of screen-out along the wellbore is remediated.

The method 800 first includes forming a wellbore. This is shown at Box 810. The wellbore defines a bore that extends into a subsurface formation. The wellbore may be formed as a substantially vertical well; more preferably, the well is drilled as a deviated well or, even more preferably, a horizontal well.

The method 800 also includes lining at least a lower portion of the wellbore with a string of production casing. This is provided at Box 820. The production casing is made up of a series of steel pipe joints that are threadedly connected, end-to-end.

The method 800 further includes placing a valve along the production casing. This is indicated at Box 840. The valve creates a removable barrier to fluid flow within the bore. Preferably, the valve is a sliding sleeve having a seat that receives a ball, wherein the ball is dropped from the surface to create a pressure seal on the seat. Other types of valves may also be used as noted below.

The method 800 also comprises perforating the production casing. This is shown at Box 850. The casing is perforated along a first zone of interest within the subsurface formation. The first zone of interest resides at or above the valve. The process of perforating involves firing shots into the casing, through a surrounding annular region (that may or may not have a cement sheath), and into the surrounding rock matrix making up a subsurface formation. This is done by using a perforating gun in the wellbore.

The method 800 next includes injecting a slurry into the wellbore. This is provided at Box 860. The slurry comprises a proppant, preferably carried in an aqueous medium. The slurry is injected in sufficient volumes and at sufficient pressures as to form fractures in the subsurface formation along the zone of interest.

The method 800 further includes pumping the slurry at a pressure sufficient to move the valve and to overcome the barrier to fluid flow. This is seen at Box 870. The pumping is done in response to a condition of screen-out along the first zone of interest created during the slurry injection. Moving the valve exposes ports along the production casing to the subsurface formation at or below the valve.

In one aspect of the method, the valve is a sliding sleeve. In this instance, moving the valve to expose ports along the production casing comprises moving or "sliding" the sleeve to expose one or more ports fabricated in the sliding sleeve. Optionally, the operator may inject a fluid (such as an aqueous fluid) under pressure through the exposed port before perforating the casing. This creates mini-fractures in the subsurface formation below the first zone of interest adjacent the sliding sleeve. In this instance, the operator will then place a rupture disc on top of the sliding sleeve to seal the bore to slurry during fracturing.

In another embodiment, the method 800 further includes placing a fracturing baffle along the production casing. The fracturing baffle resides above the frac valve but at or below the first zone of interest. The fracturing baffle may be part of a sub that is threadedly connected to the production casing proximate the valve during initial run-in. A rupture disc is then pumped down the wellbore ahead of the slurry. The disc is pumped to a depth just above the valve until the disc lands on the fracturing baffle. In this embodiment, the rupture disc is designed to rupture at a pressure that is greater than a screen-out pressure, but lower than the pressure required to move the valve.

In an alternative arrangement, the rupture disc itself is the valve. In this arrangement, the fracturing valve is not used; instead, a second rupture seat is placed below the lower zone of interest. Thus, the rupture disc that serves as the valve is an upper burst plug, while the other rupture disc is a lower burst plug.

In another embodiment, the valve is a first burst plug. The first burst plug will have a first burst rating. The ports represent perforations that are placed in the production casing in a second zone of interest below the first zone of interest. In this embodiment, moving the valve to expose ports comprises injecting the slurry at a pressure that exceeds the burst rating of the first burst plug. Optionally, in this embodiment the method further includes placing a second and a third burst plug along the production casing at or below the second zone of interest, creating a domino-effect in the event of multiple screen-outs. The second and third burst plugs will have a second burst rating that is equal to or greater than the first burst rating. When a burst plug is ruptured, a new through-opening is created through the burst plug, wherein the barrier to fluid flow has been removed.

In still another aspect, the valve that is moved is a ball-and-seat valve, while the ports are perforations earlier placed in the production casing in a second zone of interest below the first zone of interest and below the valve. In this instance, moving the valve to expose ports comprises injecting the slurry at a pressure that causes the ball to lose its pressure seal on the seat. Causing the ball to lose its pressure seal may define causing the ball to shatter, causing the ball to dissolve, or causing the ball to collapse.

The method 800 additionally includes further pumping the slurry through the exposed ports. This is shown at Box 880. In this way, the condition of screen-out is remediated. Stated another way, the "screened out" slurry is disposed of downhole in a "proppant disposal zone."

Preferably, the method 800 also includes the step of estimating a screen-out pressure along the zone of interest. This is provided at Box 830. This determining step is preferably done before the valve is placed along the production casing in the step of Box 840. The reason is so that the operator knows what type of valve to use and what pressure rating or burst rating is needed for the valve.

In a preferred embodiment of the method 800, the step of Box 850, which involves perforating the production casing, comprises pumping an autonomous perforating gun assembly into the wellbore and autonomously firing the perforating gun along the first zone of interest. The autonomous perforating gun assembly comprises a perforating gun, a depth locator for sensing the location of the assembly within the wellbore, and an on-board controller. "Autonomously firing" means pre-programming the controller to send an actuation signal to the perforating gun to cause one or more detonators to fire when the locator has recognized a selected location of the perforating gun along the wellbore. In one aspect, the depth locator is a casing collar locator and the on-board controller interacts with the casing collar locator to correlate the spacing of casing collars along the wellbore with depth. The casing collar locator identifies collars by detecting magnetic anomalies along a casing wall.

In another aspect, the on-board depth locator is a formation log such as a gamma ray log, a density log, or a neutron log. In this instance, the controller is comparing readings in real time from the logging tool with a pre-loaded formation log. Alternatively, the depth locator may be a location sensor (such as an IR reader) that senses markers placed along the casing (such as an IR transceiver). The on-board controller sends the actuation signal to the perforating gun when the location sensor has recognized one or more selected markers along the casing.

It is observed that the perforating gun, the locator, and the on-board controller are together dimensioned and arranged to be deployed in the wellbore as an autonomous unit. In this application, "autonomous unit" means that the assembly is not immediately controlled from the surface. Stated another way, the tool assembly does not rely upon a signal from the surface to know when to activate the tool. Preferably, the tool assembly is released into the wellbore without a working line. The tool assembly either falls gravitationally into the wellbore or is pumped downhole. However, a non-electric working line, such as slickline, may optionally be employed to retrieve the autonomous tool.

It is preferred that the location sensor and the on-board controller operate with software in accordance with the locating algorithm discussed above. Specifically, the algorithm preferably employs a windowed statistical analysis for interpreting and converting magnetic signals generated by the casing collar locator (or, alternatively, a formation log). In one aspect, the on-board controller compares the generated signals with a pre-determined physical signature obtained for the wellbore objects. For example, a log may be run before deploying the autonomous tool in order to determine the spacing of the casing collars or the location of formation features. The corresponding depths of the casing collars or formation features may be determined based on the speed of the wireline that pulled the logging device.

When an autonomous perforating gun assembly is used for completing a horizontal wellbore, the operator may install a hydraulically-actuated valve at the toe of the well. The hydraulically-actuated valve may be installed, for example, just upstream from a frac baffle ball-and-seat device. Additional seats or frac baffle rings, etc., may be installed further upstream of the hydraulically-actuated valve in progressively smaller sizes from top to bottom.

Preparation of the well for treatment begins by pumping down a first ball. The ball seats on the lowest, or deepest, seat below the hydraulically-actuated valve. Once seated, the casing is pressured up to a "designed" set point. For example, a 10,000 psi surface pressure may be reached by pumping an aqueous fluid. This pressure (acting on a ball landed on the seat) causes the hydraulically-actuated valve to open, exposing one or more ports along the casing. Once the ports are exposed, hydrostatic and pumping pressures cause a small opening to be formed in the subsurface formation adjacent the valve. Fresh water continues to be pumped to create a "mini" fracture in the formation. Such a fracture is shown at 458 in FIG. 4B.

It is noted that the process of forming the "mini" fracture 458 affords the operator with a real-time opportunity to evaluate the rock mechanics of the subsurface formation. Specifically, the operator is able to determine a level of pressure generally needed to initiate fractures. This may be used as part of the "estimating" step of Box 830 described above. The operator will understand that the screen-out pressure will be somewhere significantly above this initial formation-parting pressure. The operator may then select a proper sealing device, such as the rupture disc 460 of FIG. 4C or the collapsible ball 750 of FIG. 7A, for use in the well.

The sealing device is pumped down the wellbore until it is seated on the seat (or baffle ring) 462 just above the open hydraulically-actuated valve. In this condition, the sealing device creates a barrier to fluid flow through the bore of the well. At the same time, and as described above, the sealing device creates a "relief valve" that may be opened by the pressure and "fluid hammer" of a screen-out condition.

When a condition of screen-out occurs, the hydraulically-actuated valve may be self-actuated. The valve opens to provide a path for the proppant-laden fluid in the wellbore to be swept from the wellbore. The slurry flows through the ports, through the mini fracture, and into the subsurface formation at fracture treatment rates. A new autonomous perforating gun assembly may then be placed in the wellbore, pumped down, and then used to re-perforate the trouble zone. Alternatively, the new autonomous perforating gun assembly may be pumped downhole to a new zone of interest for the creation of perforations along the new zone.

Once the new zone is perforated, the well is ready for the next stage of fracture treatment. This is accomplished by then pumping down another removable sealing device and placing it in a seat upstream of the hydraulically-actuated valve. Placement of the sealing device will force fluids into the new set of perforations.

It is observed that the wellbore may be designed with more than one seat. Each seat resides above a different set of perforations, or above an open sleeve. Multiple sealing devices, or plugs, may be landed on the seats, in succession, with each having a progressively higher pressure rating. The multiple plugs are capable of "domino-ing" if needed during upset conditions. This also creates a large number of available slurry disposal zones, allowing autonomous perforating gun assemblies to be pumped into the wellbore for the perforating of the sequential zones without the need of wireline tractors or coiled tubing operations.

As can be seen, improved methods for remediating a condition of screen-out are provided herein. While it will be apparent that the inventions herein described are well calculated to achieve the benefits and advantages set forth above, it will be appreciated that the inventions are susceptible to modification, variation and change without departing from the spirit thereof.

What is claimed is:

1. A method of completing a well that averts occurrence of a hydraulic fracturing screen-out condition, comprising:

forming a wellbore, the wellbore comprising a bore extending into a subsurface formation;

lining at least a lower portion of the wellbore with a string of production casing;

placing a first valve along the production casing releasably secured in a closed position, the valve creating a removable barrier to fluid flow within the bore;

perforating the production casing along a first zone of interest within the subsurface formation, the first zone of interest residing at or above the valve, wherein perforating the production casing comprises;

pumping an autonomous perforating gun assembly into the wellbore, the autonomous perforating gun comprising;

a perforating gun;

a depth sensor for sensing the location of the perforating gun within the wellbore based on the spacing of casing collars along the wellbore; and an on-board controller configured to send an actuation signal to the perforating gun to cause one or more detonators to fire when the locator has recognized a selected location of the perforating gun along the wellbore; and autonomously firing the perforating gun along the first zone of interest;

injecting a slurry into the wellbore perforation at a first injection pressure that is below a screen-out pressure, the slurry comprising a fracturing proppant;

continuing injecting the slurry into the wellbore perforation at the first injection pressure and until the first injection pressure increases to a second injection pressure that is greater than the screen-out pressure, wherein the second injection pressure is sufficient to release and unsecure the valve to move the valve from the closed position to the open position and expose ports along the production casing to the subsurface formation at or below the valve; and further pumping the slurry through the exposed ports, thereby averting the occurrence of a screen-out condition.

2. The method of claim 1, wherein the wellbore is completed along the subsurface formation in a horizontal orientation.

3. The method of claim 2, wherein the valve is a ball-and-seat valve or a ball-and-cage valve.

4. The method of claim 1, wherein:

the valve is a sliding sleeve; and moving the valve to expose ports along the production casing comprises moving the sliding sleeve to expose one or more ports fabricated in the sliding sleeve.

5. The method of claim 1, wherein:

the valve is a rupture disc;

the ports reside adjacent a sliding sleeve below the first zone of interest; and the method further comprises:

pumping an aqueous fluid down the wellbore to move the sliding sleeve, thereby exposing the ports along the production casing;

before injecting the slurry, further injecting the aqueous fluid under pressure through the exposed ports, thereby creating fractures in the subsurface formation below the first zone of interest adjacent the sliding sleeve for receiving the slurry;

placing a baffle seat along the production casing, the seat residing above the sliding sleeve but at or below the first zone of interest;

pumping the rupture disc down the wellbore ahead of the slurry to a depth proximate the valve; and landing the rupture disc on the baffle seat, thereby creating the barrier to fluid flow; and moving the valve comprises bursting the rupture disc, wherein the rupture disc is designed to rupture at a pressure that is greater than the screen-out pressure.

6. The method of claim 1, wherein:

the valve is a first burst plug having a first burst rating;

the ports are perforations placed in the production casing in a second zone of interest below the first zone of interest; and moving the valve to expose ports comprises injecting the slurry at a pressure that exceeds the burst rating of the first burst plug.

7. The method of claim 6, further comprising:

placing a second burst plug along the production casing at or below the second zone of interest, the second burst plug having a second burst rating.

8. The method of claim 7, wherein the second burst rating is equal to or greater than the first burst rating.

9. The method of claim 1, wherein:

the valve is a ball-and-seat valve;

the ports are perforations placed in the production casing in a second zone of interest below the first zone of interest; and moving the valve to expose ports comprises injecting the slurry at a pressure that causes the ball to lose its pressure seal on the seat.

10. The method of claim 9, wherein causing the ball to lose its pressure seal comprises causing the ball to shatter, causing the ball to dissolve, or causing the ball to collapse.

11. The method of claim 1, further comprising:

estimating the screen-out pressure along the first zone of interest prior to placing the valve along the production casing.

12. The method of claim 1, further comprising:

milling out the valve after the condition of screen-out has been remediated.

13. The method of claim 1, further comprising:

while further pumping the slurry through the exposed ports, deploying another autonomous perforating gun assembly into the wellbore, the another autonomous perforating gun comprising:

a perforating gun;

a location sensor for sensing the location of the perforating gun within the wellbore during pumping; and an on-board controller configured to send an actuation signal to the perforating gun to cause one or more detonators to fire; and autonomously firing the another autonomous perforating gun along the production casing above the valve when the location sensor has recognized a selected location of the perforating gun along the wellbore, thereby creating a new set of perforations.

14. The method of claim 13, wherein:

the location sensor is a casing collar locator; and the on-board controller sends the actuation signal to the another autonomous perforating gun when the casing collar locator has recognized a selected location of the another autonomous perforating gun based on an algorithm that compares readings indicative of casing collars with a pre-stored casing collar log from the well.

15. The method of claim 13, wherein:

the location sensor is a formation logging tool; and the on-board controller sends the actuation signal to the perforating gun when the location sensor has recognized a selected location of the perforating gun based on an algorithm that compares readings indicative of the formation with a pre-stored formation log from the well.

16. The method of claim 13, wherein:

the location sensor senses markers placed along the casing; and the on-board controller sends the actuation signal to the perforating gun when the location sensor has recognized one or more selected markers along the casing.

17. The method of claim 13, wherein:

the valve is a rupture disc;

the ports reside adjacent a sliding sleeve below the zone of interest; and the method further comprises:

pumping an aqueous fluid down the wellbore to move the sliding sleeve, thereby exposing the ports along the production casing;

before injecting the slurry, further injecting the aqueous fluid under pressure through the exposed ports, thereby creating fractures in the subsurface formation below the first zone of interest adjacent the sliding sleeve for receiving the slurry;

placing a baffle seat along the production casing, the seat residing above the sliding sleeve but at or below the zone of interest;

pumping the rupture disc down the wellbore ahead of the slurry to a depth proximate the valve, the rupture disc being designed to rupture at a pressure that is greater than the screen-out pressure; and landing the rupture disc on the baffle seat.

18. The method of claim 13, wherein:

the valve is a first burst plug having a first burst rating;

the ports are perforations placed in the production casing below the zone of interest; and moving the valve to expose ports comprises injecting the slurry at a pressure that exceeds the burst rating of the first burst plug, thereby allowing the slurry to bypass the first burst plug and invade the subsurface formation through the perforations.

19. The method of claim 18, further comprising:

placing a second burst plug along the production casing below the perforations, the second burst plug having a second burst rating that is equal to or greater than the first burst rating.

* * * * *